US011428496B2

(12) United States Patent
Marriott et al.

(10) Patent No.: US 11,428,496 B2
(45) Date of Patent: Aug. 30, 2022

(54) LIMB HAVING A CORE MEMBER AND AN ARCHERY BOW INCLUDING SAME

(71) Applicant: Stress Engineering Services, Inc., Mason, OH (US)

(72) Inventors: Douglas Lewis Marriott, South Lebanon, OH (US); Shannon R. Read, Lebanon, OH (US); Clinton A. Haynes, Mason, OH (US); Daniel L. Morrow, Batavia, OH (US); Herbert E. Stumph, III, Sugar Creek Township, OH (US)

(73) Assignee: Stress Engineering Services, Inc., Mason, OH (US)

( * ) Notice: Subject to any disclaimer, the term of this patent is extended or adjusted under 35 U.S.C. 154(b) by 0 days.

(21) Appl. No.: 17/487,662

(22) Filed: Sep. 28, 2021

(65) Prior Publication Data

US 2022/0018627 A1 Jan. 20, 2022

Related U.S. Application Data

(63) Continuation-in-part of application No. 16/851,363, filed on Apr. 17, 2020, now Pat. No. 11,143,483, which is a continuation-in-part of application No. 16/096,468, filed as application No. PCT/US2017/029308 on Apr. 25, 2017, now Pat. No. 10,627,185.

(60) Provisional application No. 62/327,035, filed on Apr. 25, 2016.

(51) Int. Cl.

| | |
|---|---|
| ***F41B 5/00*** | (2006.01) |
| ***F41B 5/12*** | (2006.01) |
| ***F41B 5/14*** | (2006.01) |

(52) U.S. Cl.
CPC ..... *F41B 5/1403* (2013.01); *F41B 5/00* (2013.01); *F41B 5/12* (2013.01)

(58) Field of Classification Search
CPC ..... F41B 5/00
See application file for complete search history.

(56) References Cited

U.S. PATENT DOCUMENTS

| | | | | |
|---|---|---|---|---|
| 1,724,387 A * | 8/1929 | Wilcox | ..... | F41B 5/0026 124/23.1 |
| 1,877,273 A * | 9/1932 | Cowdery | ..... | F41B 5/0026 124/23.1 |
| 2,361,068 A * | 10/1944 | Sollid | ..... | F41B 5/0015 124/23.1 |

(Continued)

*Primary Examiner* — John A Ricci
(74) *Attorney, Agent, or Firm* — Ulmer & Berne LLP

(57) ABSTRACT

A limb for an archery bow is provided. The limb includes an outer elongate member, an inner elongate member, and a core member. The outer elongate member is formed of a first material and includes an interior surface and an exterior surface. The inner elongate member is formed of a second material and includes an interior surface and an exterior surface. The core member is formed of a third material and is sandwiched between the outer elongate member and the inner elongate member. The core member is coupled with at least a portion of each of the interior surfaces of the outer elongate member and the inner elongate member. The outer elongate member and the inner elongate member are configured to move relative to each other when the limb is bent. The first material and the second material are each stiffer than the third material.

20 Claims, 33 Drawing Sheets

(56) References Cited

U.S. PATENT DOCUMENTS 2,665,678 A * 1/1954 Bear ..... F41B 5/0015 273/DIG. 7
2,736,309 A * 2/1956 John ..... F41B 5/0073 124/23.1
2,815,015 A * 12/1957 De Giacomo ..... F41B 5/0084 273/DIG. 7
2,945,488 A * 7/1960 Cravotta ..... F41B 5/0021 273/DIG. 7
3,015,327 A * 1/1962 Lightcap ..... F41B 5/0015 273/DIG. 7
3,757,762 A * 9/1973 Cousin ..... F41B 5/0031 273/DIG. 7
3,850,156 A * 11/1974 Eicholtz ..... F41B 5/0015 273/DIG. 7
4,712,533 A * 12/1987 Cruise ..... F41B 5/0063 273/DIG. 7
4,819,608 A * 4/1989 Filice ..... F41B 5/0042 124/23.1
5,165,382 A * 11/1992 Morrison ..... F41B 5/0073 124/88
5,657,739 A * 8/1997 Smith ..... F41B 5/10 273/DIG. 1
5,881,704 A * 3/1999 Andrews ..... F41B 5/10 124/23.1
6,718,962 B2 * 4/2004 Adcock ..... F41B 5/0073 124/23.1
6,932,071 B2 * 8/2005 Gallops, Jr. ..... F41B 5/10 124/23.1
7,438,069 B2 * 10/2008 Simonds ..... F41B 5/0026 124/23.1
8,635,994 B1 * 1/2014 Yehle ..... F41B 5/0068 124/23.1
9,091,503 B2 * 7/2015 Howard ..... F41B 5/10
10,627,185 B2 * 4/2020 Marriott ..... F41B 5/123
2002/0029773 A1 * 3/2002 Park ..... F41B 5/0063 124/23.1
2004/0077440 A1 * 4/2004 Kronfeld ..... F41B 5/1426 473/578
2008/0072887 A1 * 3/2008 Park ..... F42B 5/10 124/23.1
2009/0050125 A1 * 2/2009 Davis ..... F41B 5/0026 124/88

* cited by examiner

LIMB HAVING A CORE MEMBER AND AN ARCHERY BOW INCLUDING SAME

REFERENCE TO RELATED APPLICATION

This application is a continuation-in-part of U.S. patent application Ser. No. 16/851,363 entitled Limb Having a Core Member and an Archery Bow Including Same, filed Apr. 17, 2020, which is a continuation-in-part of U.S. patent application Ser. No. 16/096,468 entitled Bow Limb and Archery Bow Using Same, filed Oct. 25, 2018, which is the U.S. national stage entry of PCT/US17/29308 entitled Bow Limb and Archery Bow Using Same, filed Apr. 25, 2017, which claims priority to U.S. provisional patent application Ser. No. 62/327,035, entitled Pair of Bow Limbs and Crossbow Using Same, filed Apr. 25, 2016, and hereby incorporates these applications by reference herein in their respective entireties.

TECHNICAL FIELD

The apparatus and methods described below generally relate to a pair of bow limbs for an archery bow such as, for example, a crossbow, a vertical bow, or a compound bow.

BACKGROUND

Conventional archery bows have bow limbs that are formed of synthetic composite materials, such as fiber reinforced plastic (FRP), which can include carbon-fiber reinforced plastic and/or fiberglass. These synthetic composite materials are expensive, difficult to manufacture, and subject to inconsistencies during manufacturing which can affect the performance of the archery bow.

SUMMARY

In accordance with one embodiment, a limb for an archery bow is provided. The limb includes an outer elongate member, an inner elongate member, and a core member. The outer elongate member is formed of a first material and includes an interior surface and an exterior surface. The inner elongate member is formed of a second material and includes an interior surface and an exterior surface. The core member is formed of a third material and is sandwiched between the outer elongate member and the inner elongate member. The core member is coupled with at least a portion of each of the interior surfaces of the outer elongate member and the inner elongate member. The outer elongate member defines a first plurality of through holes. The inner elongate member defines a second plurality of through holes. The core member extends at least partially into each of the first plurality of through holes and the second plurality of through holes. The outer elongate member and the inner elongate member are configured to move relative to each other when the limb is bent. The first material and the second material are each stiffer than the third material.

In accordance with another embodiment, a limb for an archery bow is provided. The limb includes an outer elongate member, an inner elongate member, and a core member. The outer elongate member is formed of a first material and includes an interior surface and an exterior surface. The inner elongate member is formed of a second material and includes an interior surface and an exterior surface. The core member is formed of a third material and is sandwiched between the outer elongate member and the inner elongate member. The core member is coupled with at least a portion of each of the interior surfaces of the outer elongate member and the inner elongate member. The outer elongate member includes a first plurality of internal rib members that extend into the core member. The inner elongate member includes a second plurality of internal rib members that extend into the core member. The outer elongate member and the inner elongate member are configured to move relative to each other when the limb is bent. The first material and the second material are each stiffer than the third material.

In accordance with yet another embodiment, a limb for an archery bow is provided. The limb includes an outer elongate member, an inner elongate member, and a core member. The outer elongate member is formed of a first material and includes an interior surface and an exterior surface. The inner elongate member is formed of a second material and includes an interior surface and an exterior surface. The core member is formed of a third material and is sandwiched between the outer elongate member and the inner elongate member. The core member is coupled with at least a portion of each of the interior surfaces of the outer elongate member and the inner elongate member. The interior surface of the outer elongate member includes first textured portions. The interior surface of the inner elongate member includes second textured portions. Each of the first and second textured portions interface with the core member to facilitate mechanical coupling and resistance of shear between the core member and the outer and inner elongate members. The outer elongate member and the inner elongate member are configured to move relative to each other when the limb is bent. The first material and the second material are each stiffer than the third material.

BRIEF DESCRIPTION OF THE DRAWINGS

It is believed that certain embodiments will be better understood from the following description taken in conjunction with the accompanying drawings in which.

DETAILED DESCRIPTION

Figure 1A:
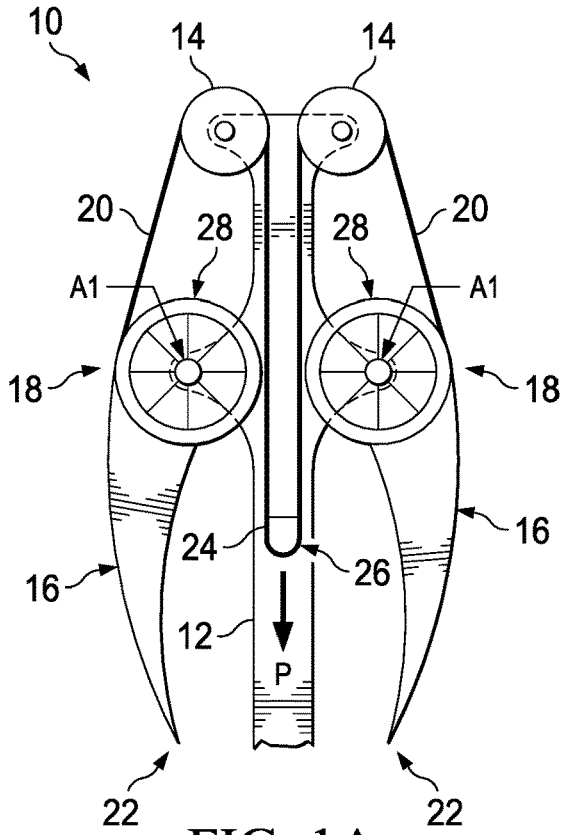
FIGS. 1A-1B are various views depicting a crossbow, in accordance with one embodiment.
Figure 1B:
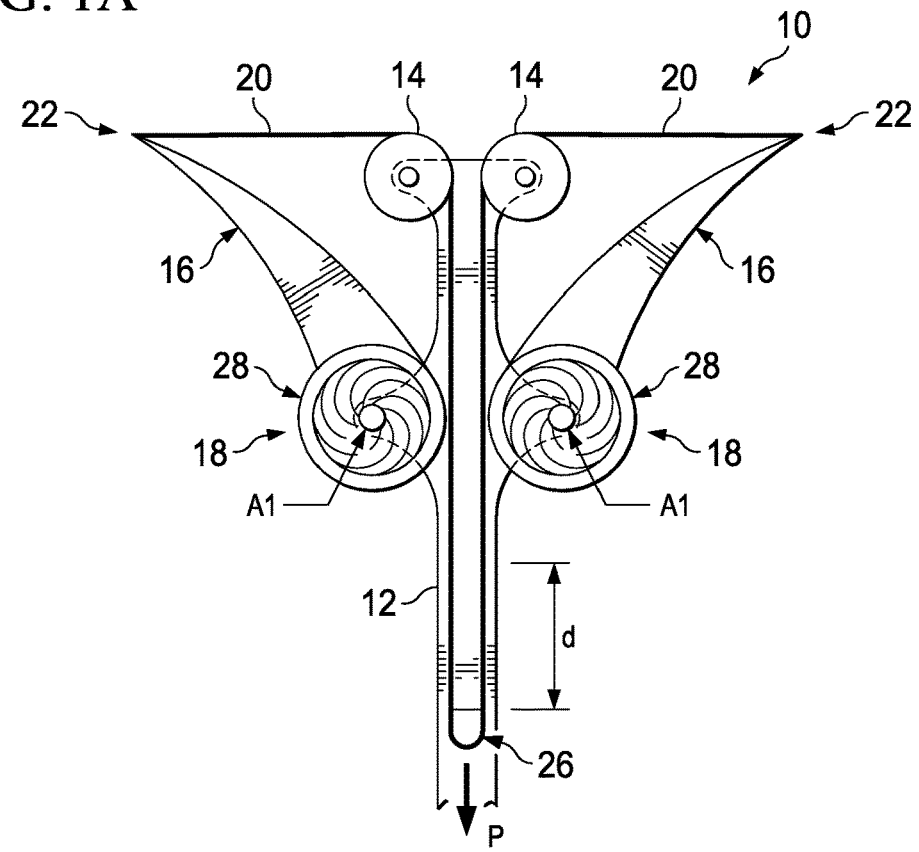
Figure 1C:
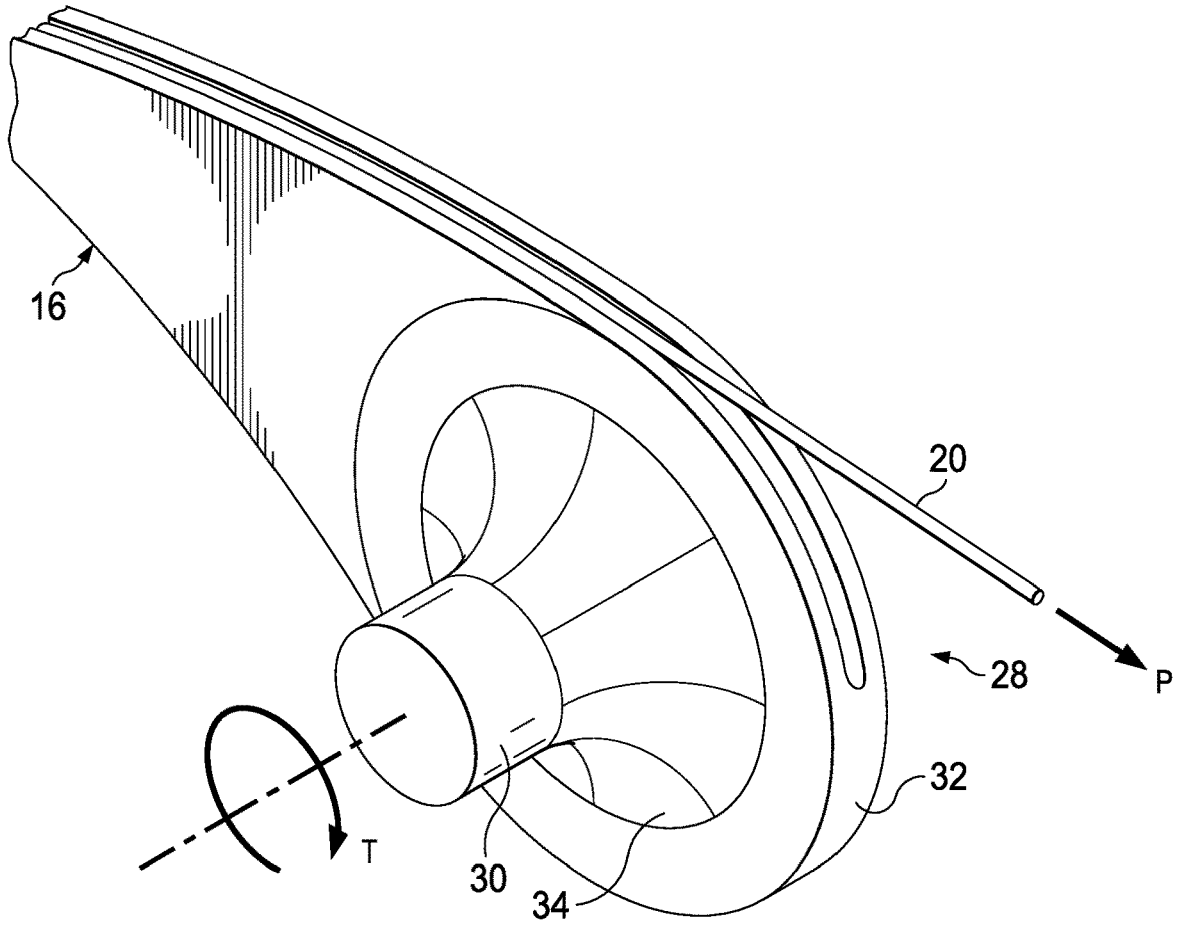
FIGS. 1C-1E are various views depicting a bow limb of the crossbow of FIGS. 1A-1B.
Figure 1D:
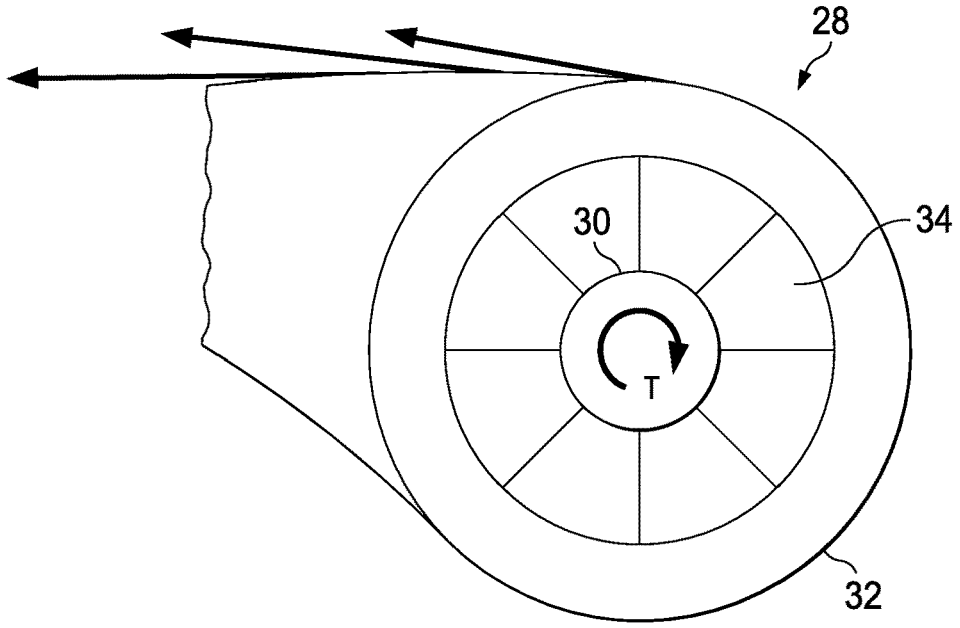
Figure 1E:
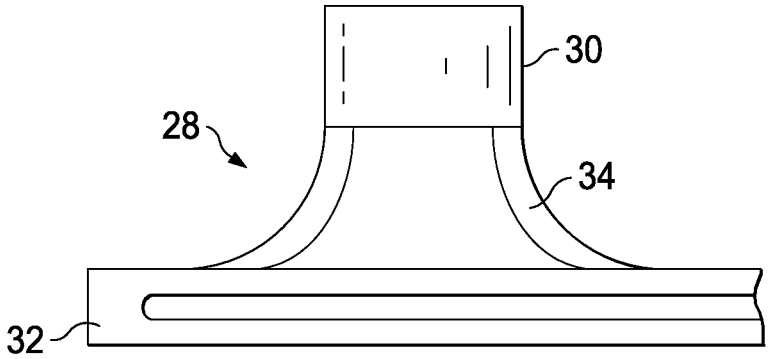

Selected embodiments are hereinafter described in detail in connection with the views and examples of FIGS. 1A-1F, 2A-2K, 3A-3D, 4A-4D, and 5-42. A crossbow 10 in accordance with one embodiment is generally depicted in FIGS. 1A and 1B. The crossbow 10 can include a stock 12, a pair of pulleys 14 (e.g., cams) rotatably coupled to the stock 12, and a pair of bow limbs 16. Each of the bow limbs 16 can be rotatably coupled with the stock 12 at a proximal end 18 such that the bow limbs 16 are rotatable with respect to the stock 12 about respective limb axes A1 between a relaxed position (FIG. 1A) and a loaded position (FIG. 1B). A bow string 20 can be attached to distal ends 22 of the bow limbs 16 and routed from the distal ends 22, around the pulleys 14, and around a stop portion 24 (FIG. 1A). The bow string 20 can include a nocking portion 26 that is routed around the stop portion 24. It is to be appreciated that any of a variety of suitable alternative stocks can be provided for use with the bow limbs 16.

A spring 28 can be disposed at each of the distal ends 22 of the bow limbs 16 and can facilitate rotatable coupling of the bow limbs 16 to the stock 12. The springs 28 can be configured to bias the bow limbs 16 into the relaxed position. When the bow limbs 16 are in the relaxed position, as illustrated in FIG. 1A, a nock of an arrow (e.g., adjacent to 136 in FIG. 2A) can be engaged with the nocking portion 26 of the bow string 20 and the arrow can be laid between the springs 28 to load the arrow into the crossbow 10. The arrow can then be pulled rearwardly (e.g., in the direction of arrow P) which can pull the bow limbs 16 into the loaded position, and a catch (e.g., adjacent to 140 in FIG. 2A) can hold the nocking portion 26 in position. To release (e.g., fire) the arrow, a user can pull a trigger (e.g., 142 in FIG. 2A) which releases the catch. The springs 28 can pull the bow limbs 16 towards the relaxed position which can pull the nocking portion 26 forwardly (in the opposite direction as arrow P) which can release the arrow.

The springs 28 can be provided in a torsion spring type arrangement. For example, referring now to FIGS. 1C-1E, one of the springs 28 is shown to include a spindle 30 that is flexibly coupled with an outer collar 32 by a flexible body 34. In one embodiment, the flexible body 34 can comprise an elastomeric material, such as a vulcanized isoprene rubber (e.g., natural rubber), for example. The spindle 30 can be rigidly coupled with the stock 12 and the outer collar 32 can be rigidly coupled with the rest of the bow limb 16. When the bow limb 16 is moved from the relaxed position to the loaded position, the spindle 30 pivots with respect to the outer collar 32 (in the direction of arrow T). The flexible body 34 opposes this pivoting, thus biasing the bow limb 16 towards the relaxed position. When the bow string 20 is released (e.g., when the trigger (not shown) is actuated), the flexible body 34 facilitates pivoting of the spindle 30 (in a direction opposite arrow T) to pull the bow limb 16 towards the relaxed position, thus releasing the arrow. It is to be appreciated that the springs 28 can be provided in any of a variety of arrangements that facilitate biasing of the bow limbs 16 towards the relaxed position. It is also to be appreciated that since the springs 28 provide propulsion for the arrow, the rest of the bow limbs 16 can be formed of a material that is less expensive, more durable, and easier to make than carbon fiber reinforced plastic (CFRP) and/or fiberglass, such as high strength steel (HSS).

The elastomeric material used for the springs 28 and the HSS used for the bow limbs 16 can be more cost effective and easier to manufacture than conventional CFRP and/or fiberglass bow limbs. In addition, the material properties of the elastomeric material used for the springs 28 and the HSS used for the bow limbs 16 can be more easily controlled during manufacturing. As a result, the performance of the springs 28 and the bow limbs 16 are more predictable, which can reduce or eliminate the need to tune or match performance characteristics of the bow limbs as is oftentimes the case with CFRP and/or fiberglass bow limbs.

It is to be appreciated that the effectiveness of the springs 28 can be affected by the shape of the flexible material as well as two of its material properties—the maximum allowable stress (σ) and the Stiffness modulus (E). The maximum allowable stress (σ) can be described as the amount of load that the flexible/elastic material of the springs 28 can support before breaking. The Stiffness modulus (E) can be described as the amount of deformation of the material upon the application of an applied load. It is also to be appreciated that the energy storage capacity of a spring can be defined as the Specific Strain Energy (SSE). The formula for SSE can be defined by the following equation:

$$SSE = \frac{\eta \times \sigma^2}{E}$$

where η is the efficiency factor of the flexible material. The higher the efficiency factor, the better the material is able to store energy which can result in a more lightweight design.

Figure 1F:
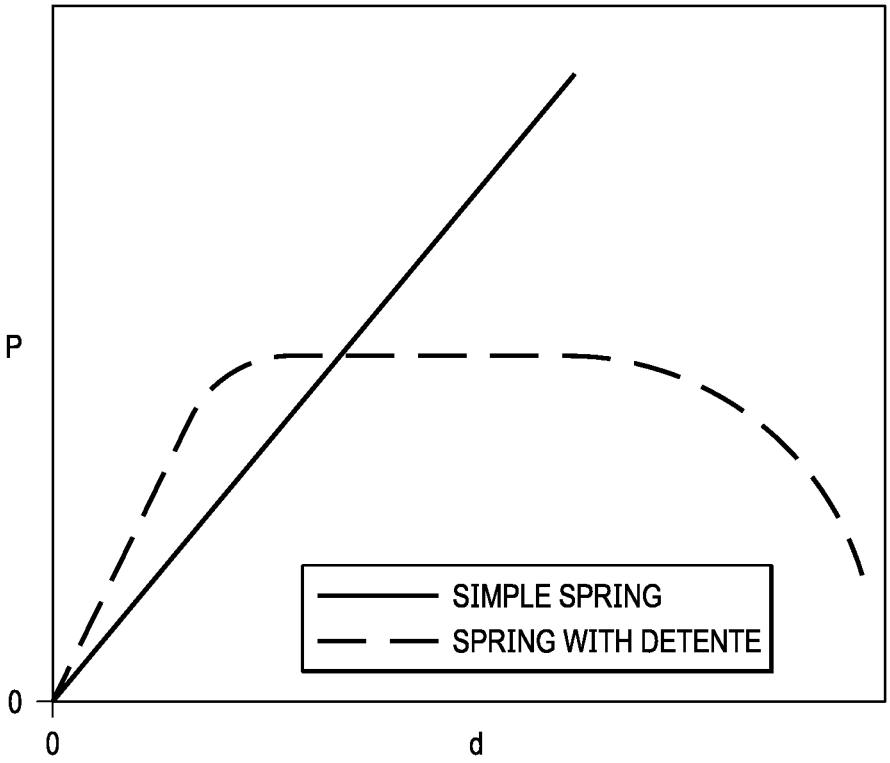
FIG. 1F is a plot depicting a relationship between pull distance and pull force of a bow string of the crossbow of FIGS. 1A-1E.

Referring now to FIG. 1F, a plot is depicted showing the relationship between the pull distance (d) and the pull force (P) of the bow string 20 as a result of the springs 28 as compared with a simple spring. As illustrated, initially, as the bow string 20 is pulled rearwardly, the force required to pull the bow string 20 increases. Eventually, as the bow string 20 continues rearwardly, the force required to pull the bow string 20 stays substantially the same and then decreases as the nocking portion 26 (FIGS. 1A and 1B) approaches the catch and is pulled into a fully drawn back position. This eventual decrease in required force is called "let-off" (e.g., détente) and can reduce fatigue in a user. By comparison, the force on the string of a crossbow with a simple string increases through the travel of the spring rearwardly which can fatigue a user during pullback.

Figure 2A:
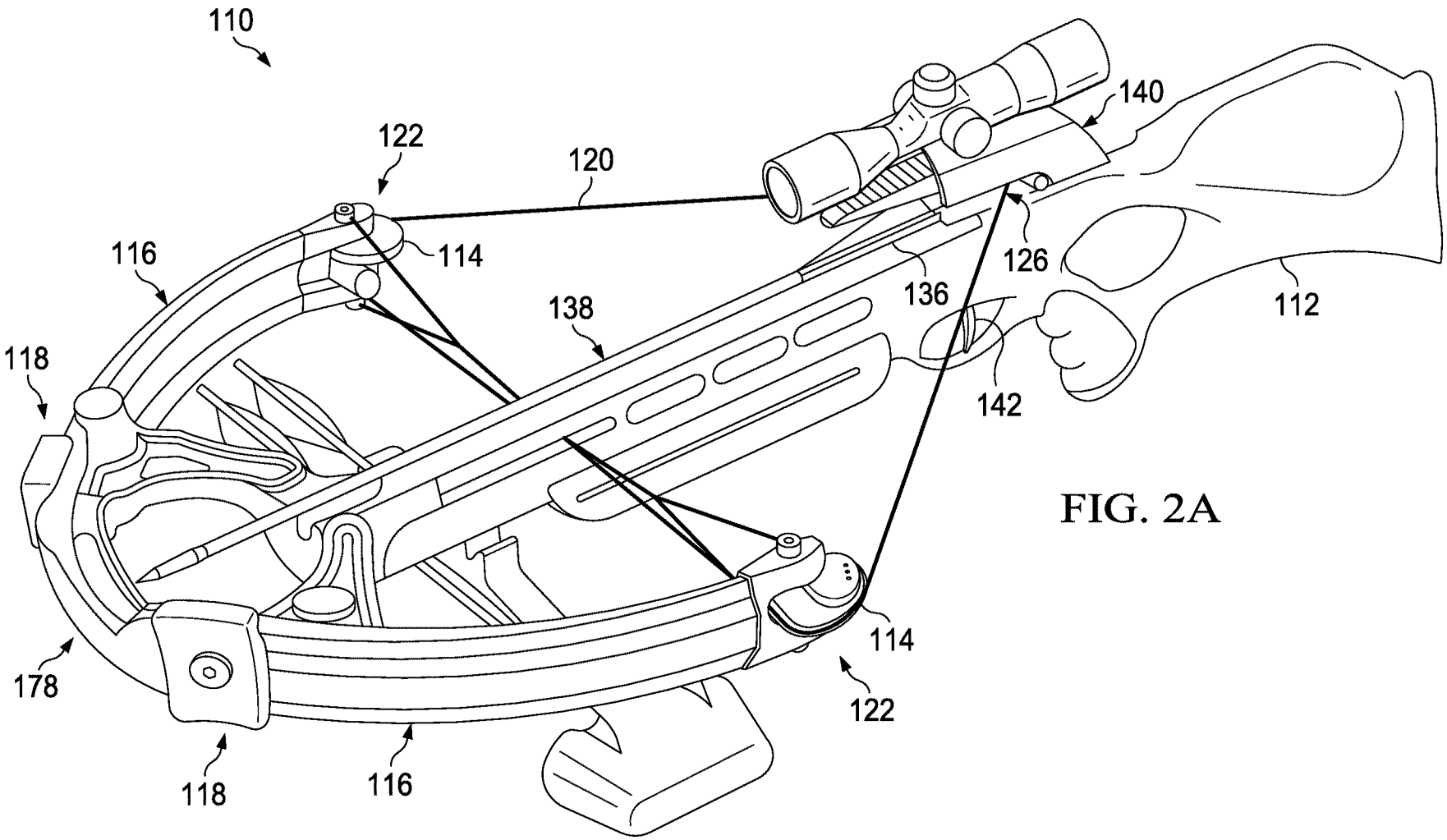
FIG. 2A is a front isometric view depicting a crossbow, in accordance with another embodiment.

FIG. 2A illustrates an alternative embodiment of a crossbow 110 that is similar to or the same as in many respects as the crossbow 10 of FIGS. 1A-1E. For example, the crossbow 110 can have a stock 112, a pair of pulleys 114, a pair of bow limbs 116, and a bow string 120. However, a proximal end 118 of each of the bow limbs 116 can be rigidly coupled with the stock 112 by a riser 178, and the pulleys 114 can be disposed at respective distal ends 122 of the bow limbs 116. The bow string 120 can be routed around the pulleys 114. When the bow limbs 116 are in the relaxed position (not shown), the bow string 120 can be pulled rearwardly which can pull the bow limbs 16 into the loaded position as shown in FIG. 2A. When the bow string 120 is fully drawn back, the nocking portion 126 can engage a catch 140 which can hold the nocking portion 126 in the fully drawn back position until it is eventually released (e.g., by a trigger 142).

Figure 2B:
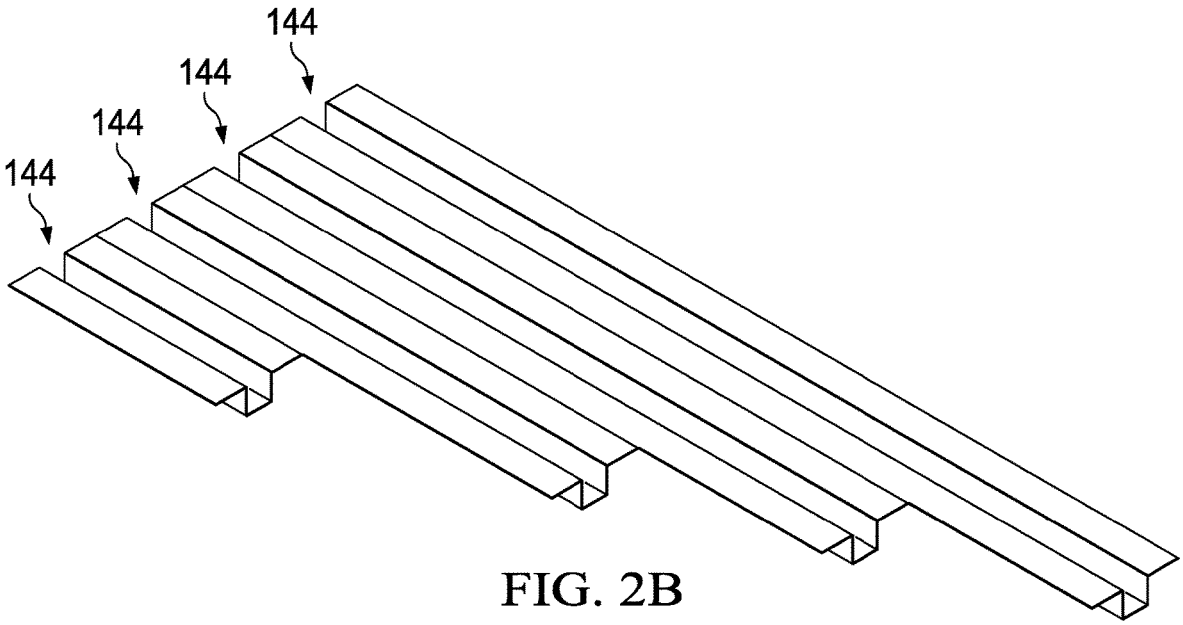
FIGS. 2B-2I are various views depicting a bow limb for the crossbow of FIG. 2A, in accordance with another embodiment.
Figure 2C:
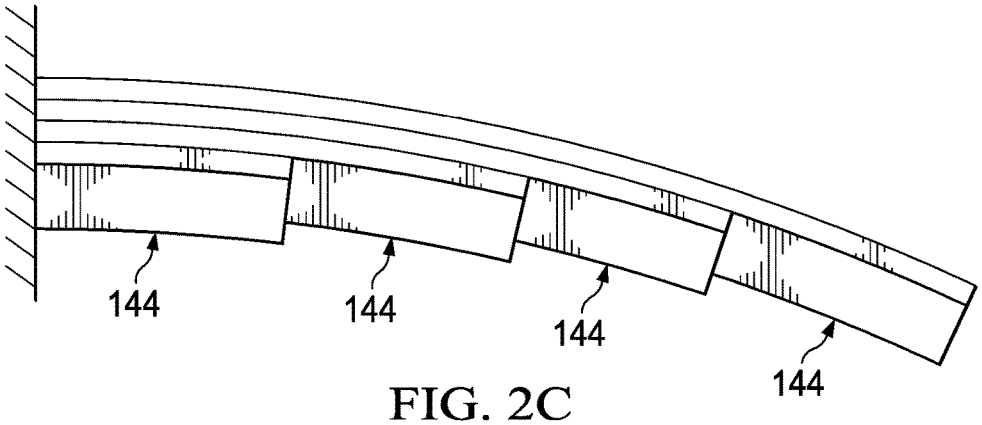
Figure 2D:
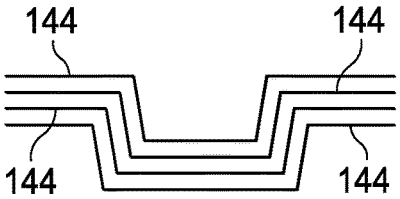
Figure 2E:
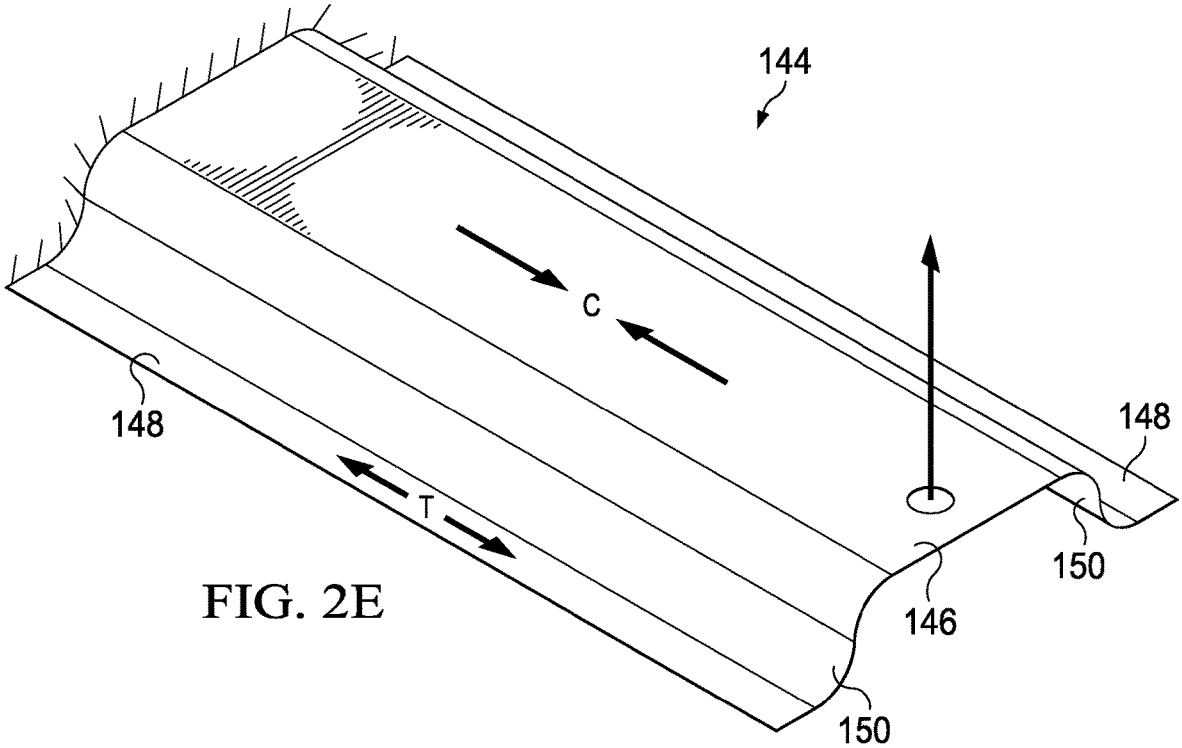
Figure 2F:
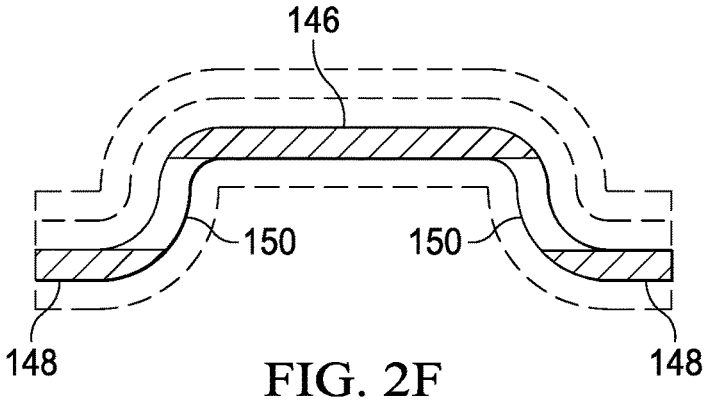
Figure 2G:
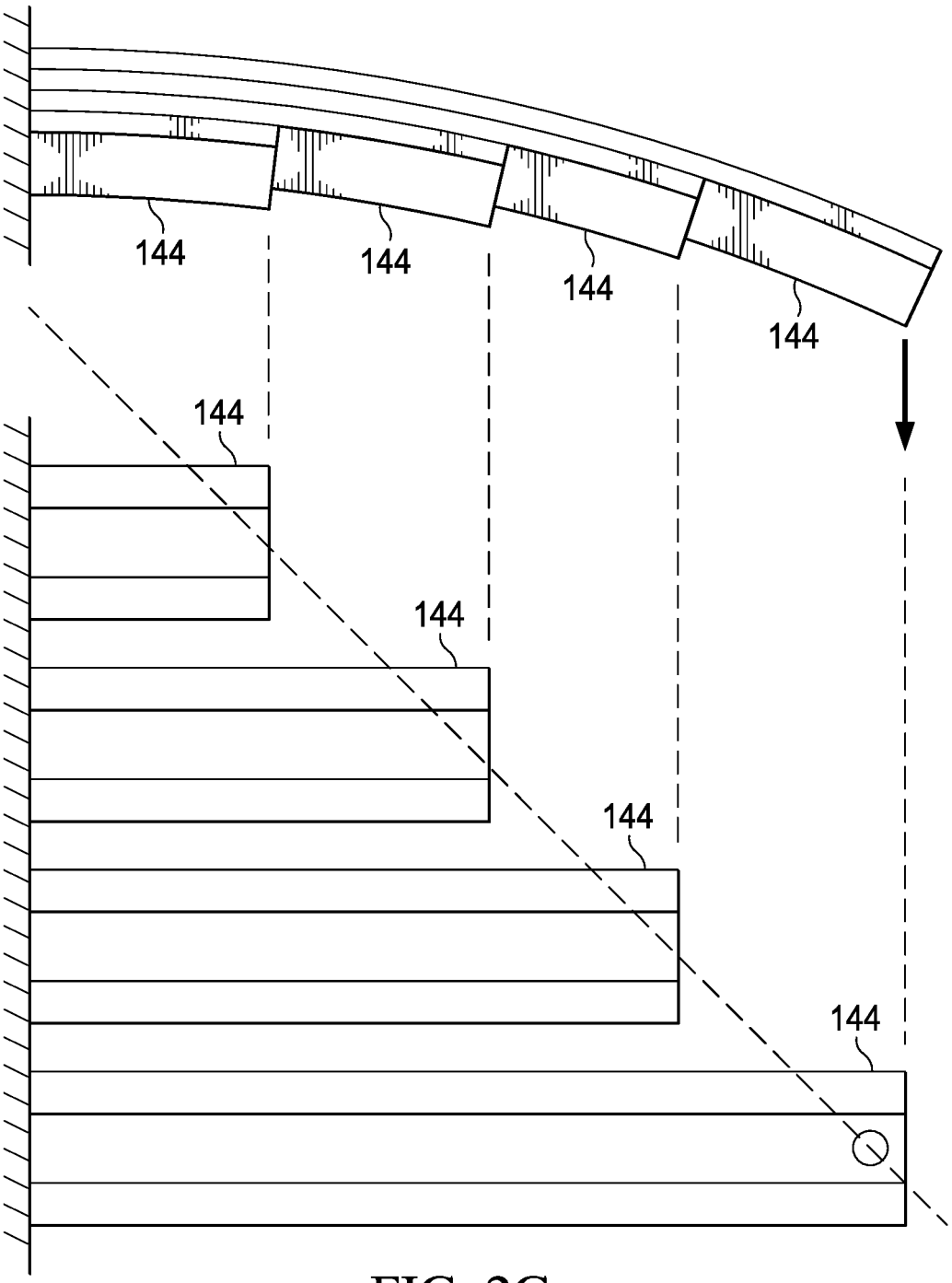
Figure 2H:
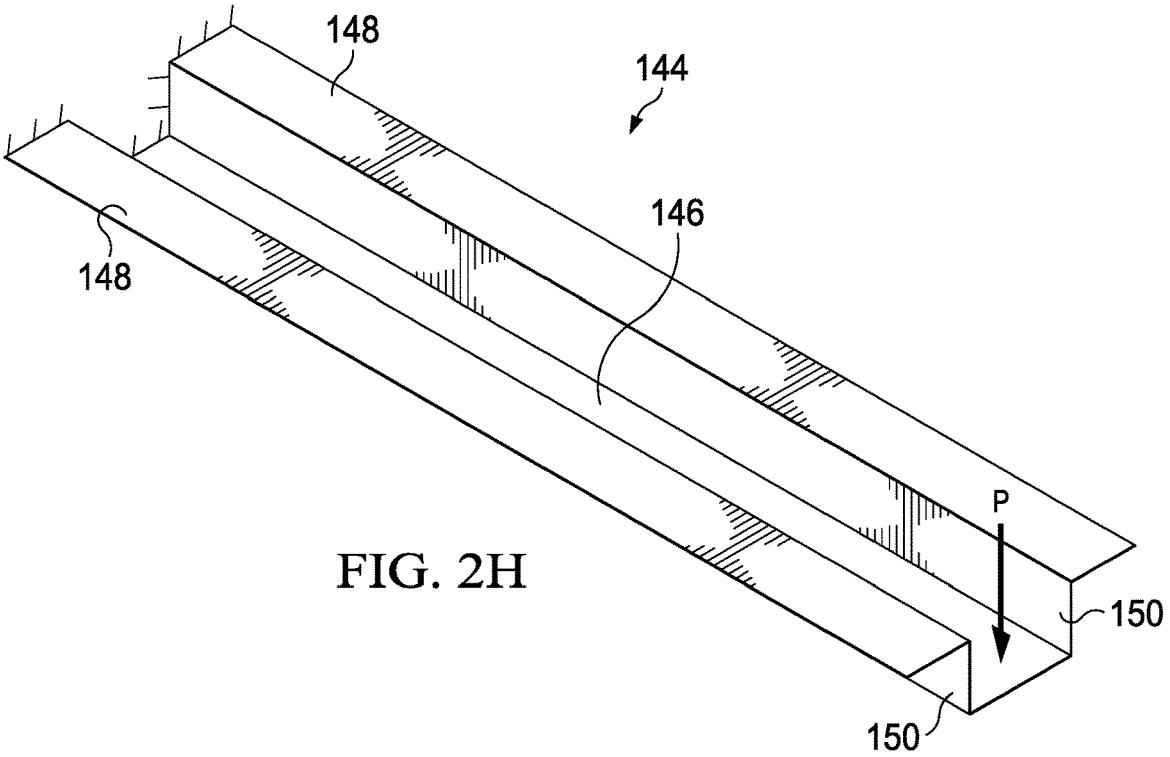
Figure 2I:
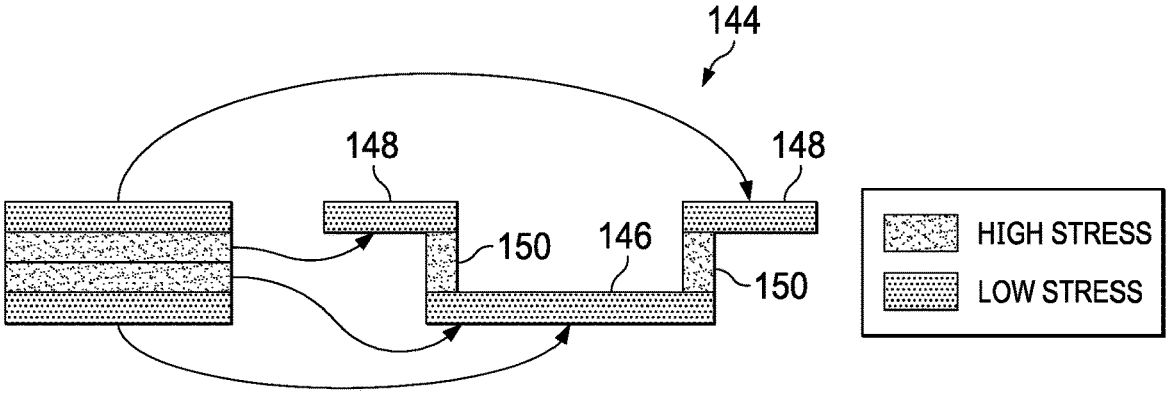

Referring now to FIGS. 2B-2J, each of the bow limbs 116 can be formed of a plurality of leaf plates 144 that can have different lengths (as shown in FIGS. 2B and 2G) and can be stacked on top of each other (as shown in FIGS. 2C and 2G) to form each bow limb 116. The leaf plates 144 can be stacked in such a manner that the outermost leaf plate 144 (the leaf plate 144 that extends along the front most portion of the crossbow 110 when the bow limbs 116 are in the relaxed position) is the longest and overlies shorter leaf plates 144. Each of the leaf plates 144 is arranged such that it is shorter than the one that overlies it. Each of the leaf plates 144 can have a cross-sectional profile that resembles a top hat. More particularly, each of the leaf plates 144 can have an upper portion 146 and a pair of lower edge portions 148 that are spaced from each other and substantially parallel with each other. A pair of wall portions 150 can extend between the upper portion 146 and the pair of lower edge portions 148. The pair of wall portions 150 can be spaced from each other and substantially parallel with each other. This top-hat type arrangement provides more material in high stress locations than in low stress locations (see FIG. 2I). It is to be appreciated that each of the leaf plates 144 can be configured to be slightly smaller or larger than the adjacent leaf plates 144 to accommodate stacking (see FIG. 2D). Although the bow limbs 116 are shown in FIG. 2A to be arranged such that the upper portion 146 extends along the front most portion of the crossbow 110, it is appreciated that the bow limbs 116 can alternatively be arranged in a reverse orientation such that the pair of lower edge portions 148 extend along the front most portion of the crossbow 110.

The leaf plates 144 can be formed of a metal or metal alloy such as high strength steel (HSS), beryllium copper, phosphor bronze, and/or titanium, for example. In one embodiment, all of the leaf plates 144 can be formed of the same material while in another embodiment, some or all of the leaf plates can be formed of different material. It is to be appreciated that by forming the leaf plates 144 from a metal or metal alloy, the bow limbs 116 can be less expensive, more durable, and easier to make than CFRP and/or fiberglass. In addition, the bow limbs 116 can be more cost effective, easier to manufacture, and the material properties can be more easily controlled during manufacturing.

Figure 2J:
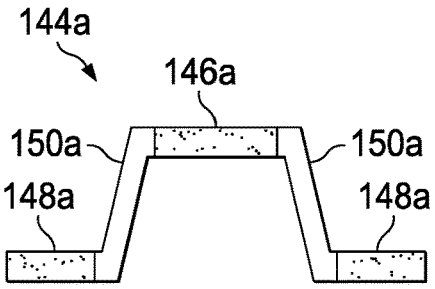
FIG. 2J is a cross-sectional view depicting a bow limb, in accordance with yet another embodiment.
Figure 2K:
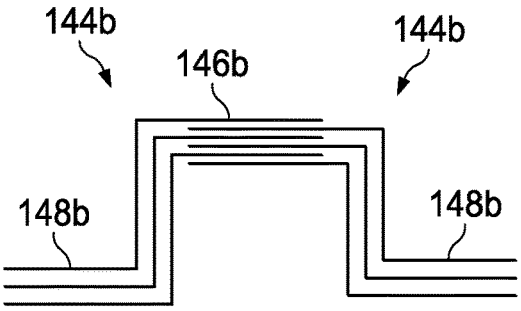
FIG. 2K is a cross-sectional view depicting a bow limb, in accordance with still yet another embodiment.
Figure 3A:
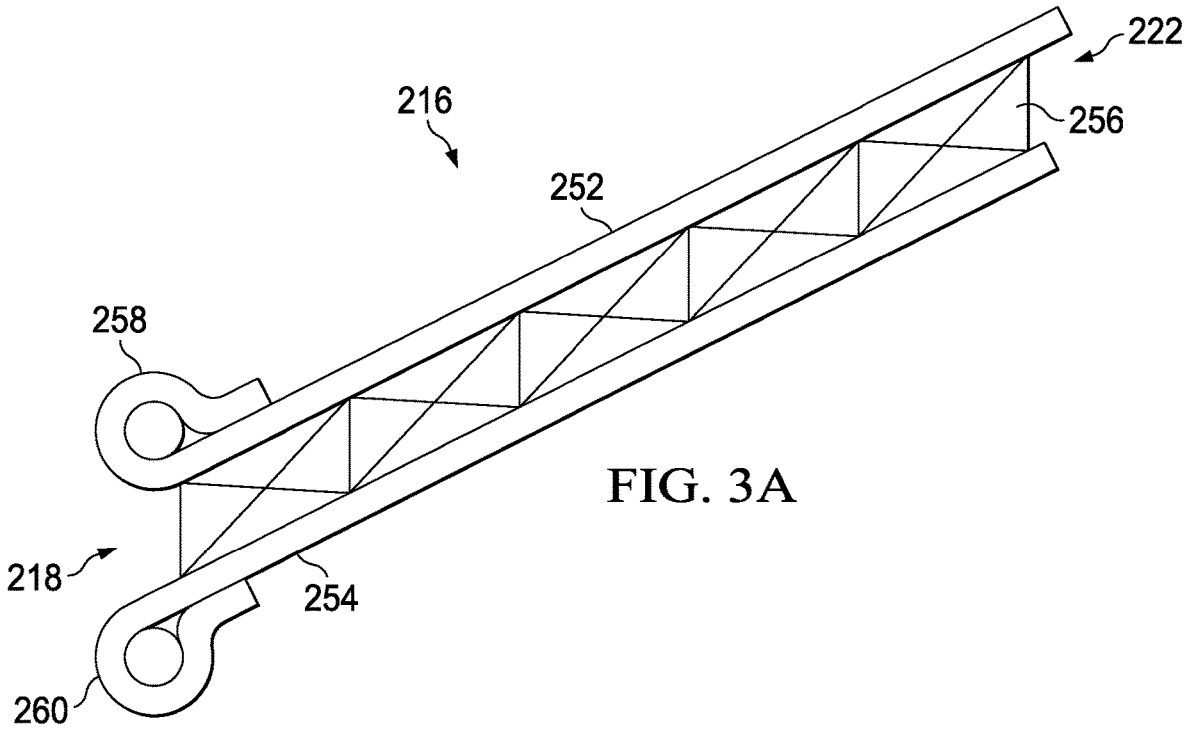
FIGS. 3A-3D are various views depicting a bow limb of a crossbow, in accordance with still yet another embodiment.
Figure 3B:
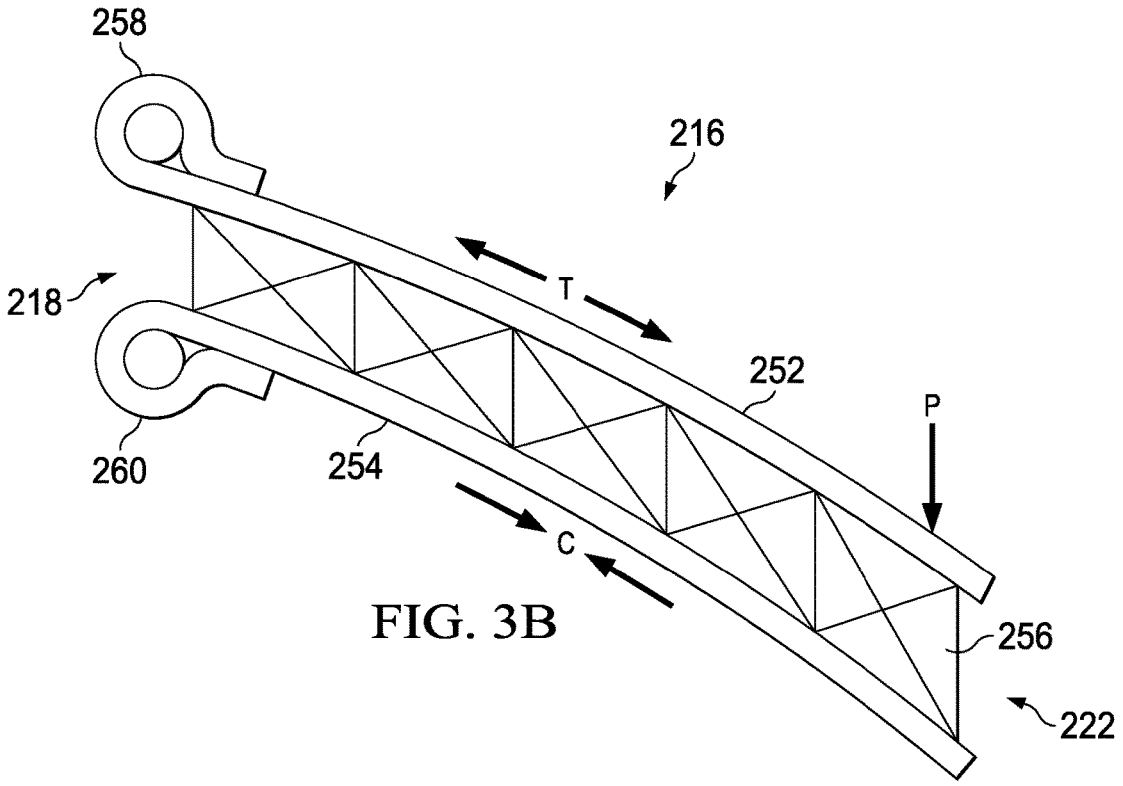
Figure 3C:
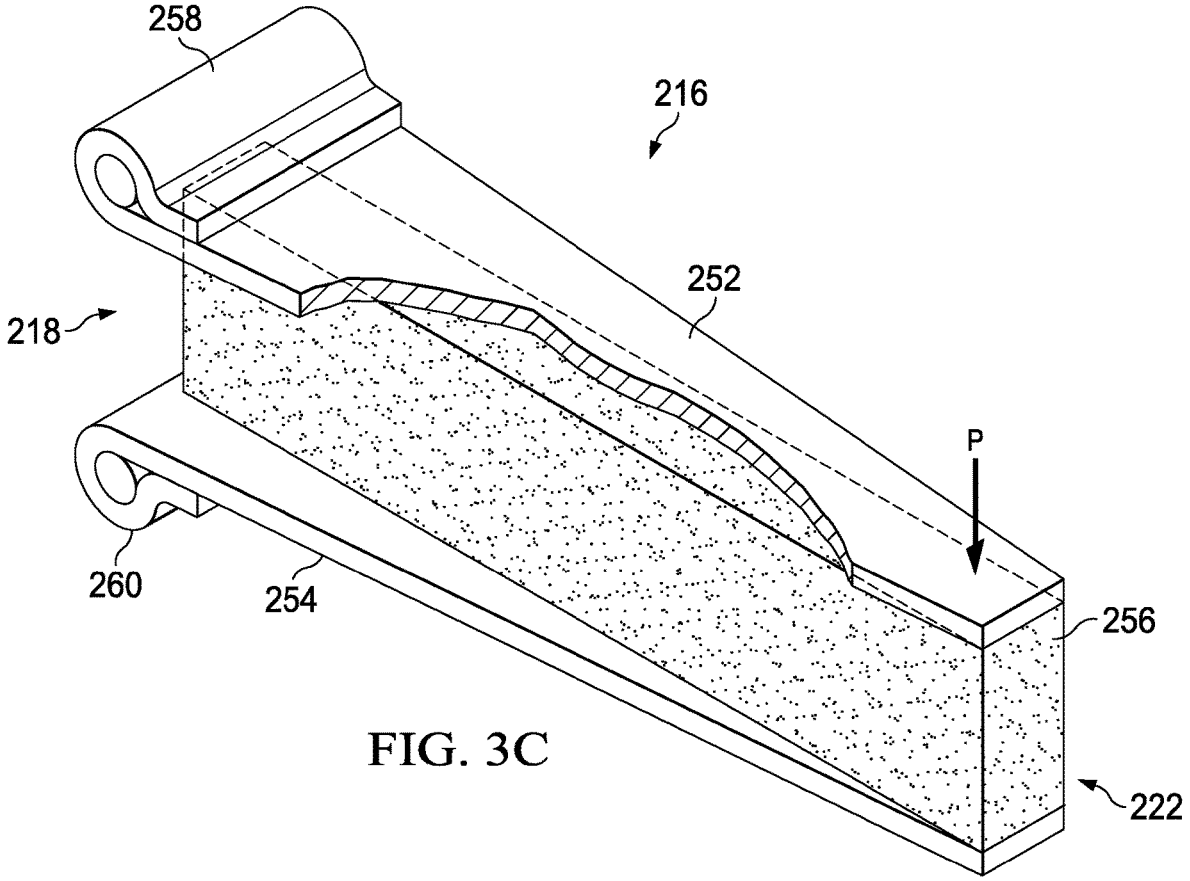
Figure 3D:
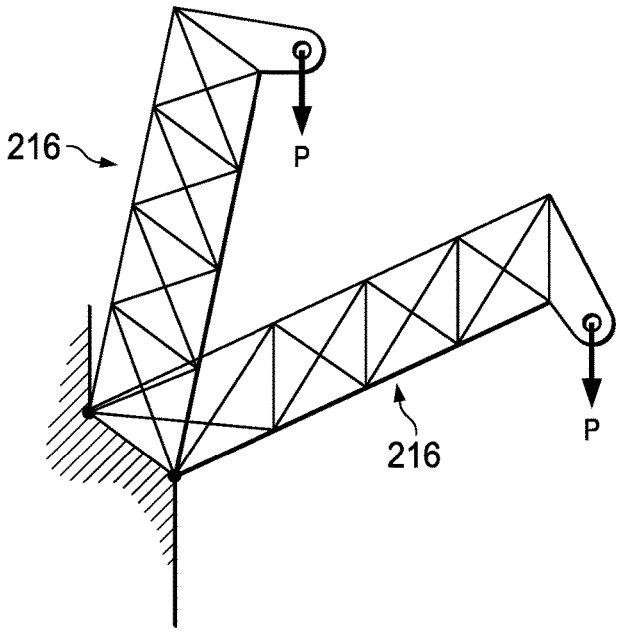

FIGS. 2J and 2K illustrate alternative embodiments of leaf plates 144*a* and 144*b*, respectively, that are similar to or the same as in many respects as the leaf plates 144 of FIGS. 2A-2J. However, the leaf plate 144*a* of FIG. 2J has wall portions 150*a* that are angled with respect to an upper portion 146*a* and lower edge portions 148*a*. The leaf plates 144*b* of FIG. 2K only have one of each of an upper portion 146*b*, a lower edge portion 148*b*, and a wall portion 150*b*.

FIGS. 3A-3D illustrate an alternative embodiment of a bow limb 216 that is similar to or the same as in many respects as the bow limbs 116 of FIGS. 2A-2I. For example, the bow limb 216 can have a proximal end 218 that is configured to be rigidly coupled with a stock (not shown), and a pulley (not shown) can be disposed at a distal end 222 of the bow limbs 216. However, the bow limb 216 can include an upper plate member 252, a lower plate member 254, with a cushioning member 256 sandwiched in between. Each of the upper and lower plate members 252, 254 can include respective mounting sleeves 258, 260 that facilitate mounting of the bow limb 216 to the stock (e.g., with pins). The upper and lower plate members 252, 254 can be formed of a metal or metal alloy such as high strength steel (HSS), beryllium copper, phosphor bronze, and/or titanium, for example. In one embodiment, the upper and lower plate members 252, 254 can be formed of the same material while in another embodiment, the upper and lower plate members 252, 254 can be formed of different material. The cushioning member 256 can be formed of an elastomeric material, such as a vulcanized isoprene rubber (e.g., natural rubber), for example.

Figure 43:
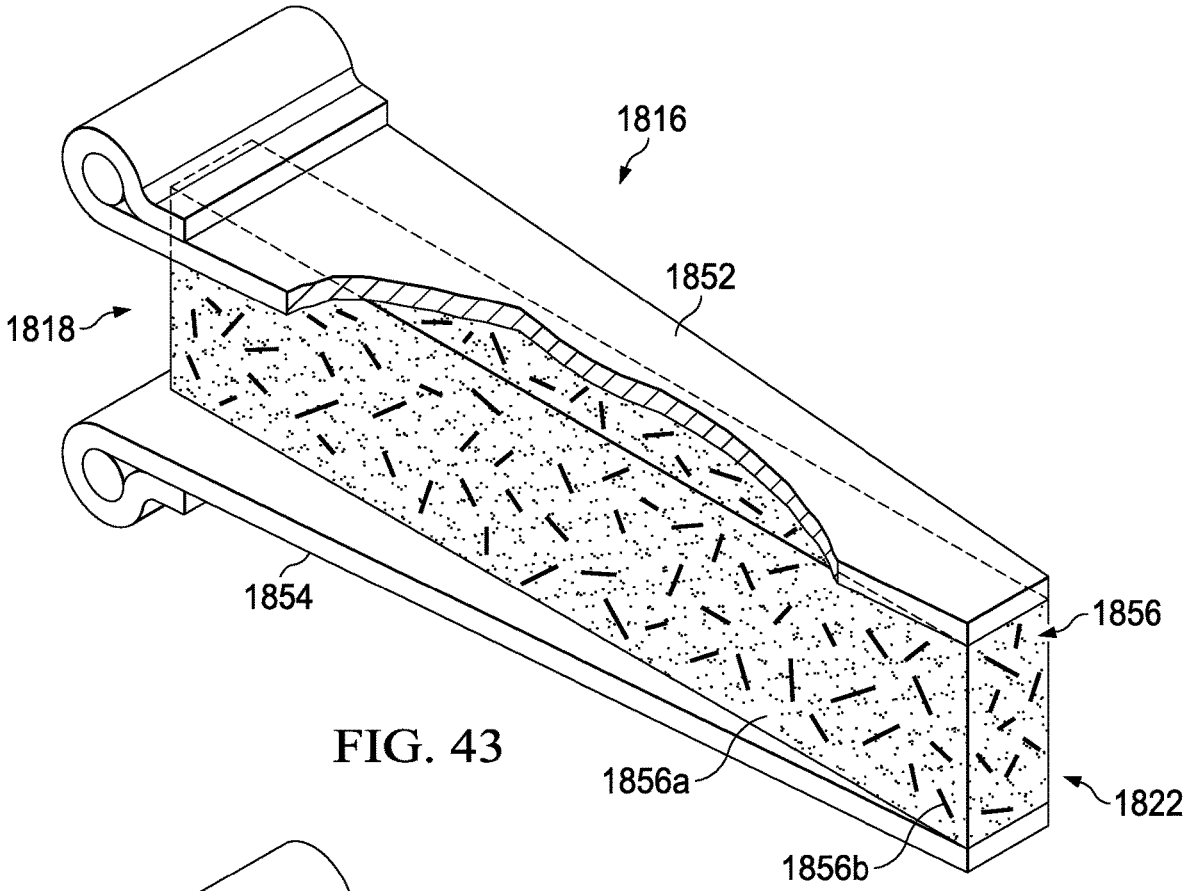
FIG. 43 is an enlarged front isometric view depicting a bow limb, in accordance with yet another embodiment, wherein an upper plate member is shown partially cut away for clarity of illustration.

It will be appreciated that a cushioning member can be provided in any of a variety of other suitable configurations. For example, FIG. 43 illustrates a bow limb 1816 that is similar to or the same as in many respects to the bow limb 216 of FIG. 3C as, for example, the bow limb 1816 is shown to extend from a proximal end 1818 to a distal end 1822, and to include an upper plate member 1852, a lower plate member 1854, and a cushioning member 1856 sandwiched in between. The upper and lower plate members 1852, 1854 can be formed of a metal, metal alloy or other material(s), and each can be formed of like or different material(s) relative to one another. The cushioning member 1856 is shown to be formed from an elastomeric material 1856*a* (e.g., vulcanized isoprene or natural rubber) that is reinforced by fibers 1856*b*. It will be appreciated that, in one embodiment, each of the fibers throughout the entirety of the cushioning member can be formed of the same material and of uniform length and diameter. However, it will be appreciated that in other embodiments, fibers of varying materials, lengths and/or diameters can be included within a cushioning member.

Figure 44:
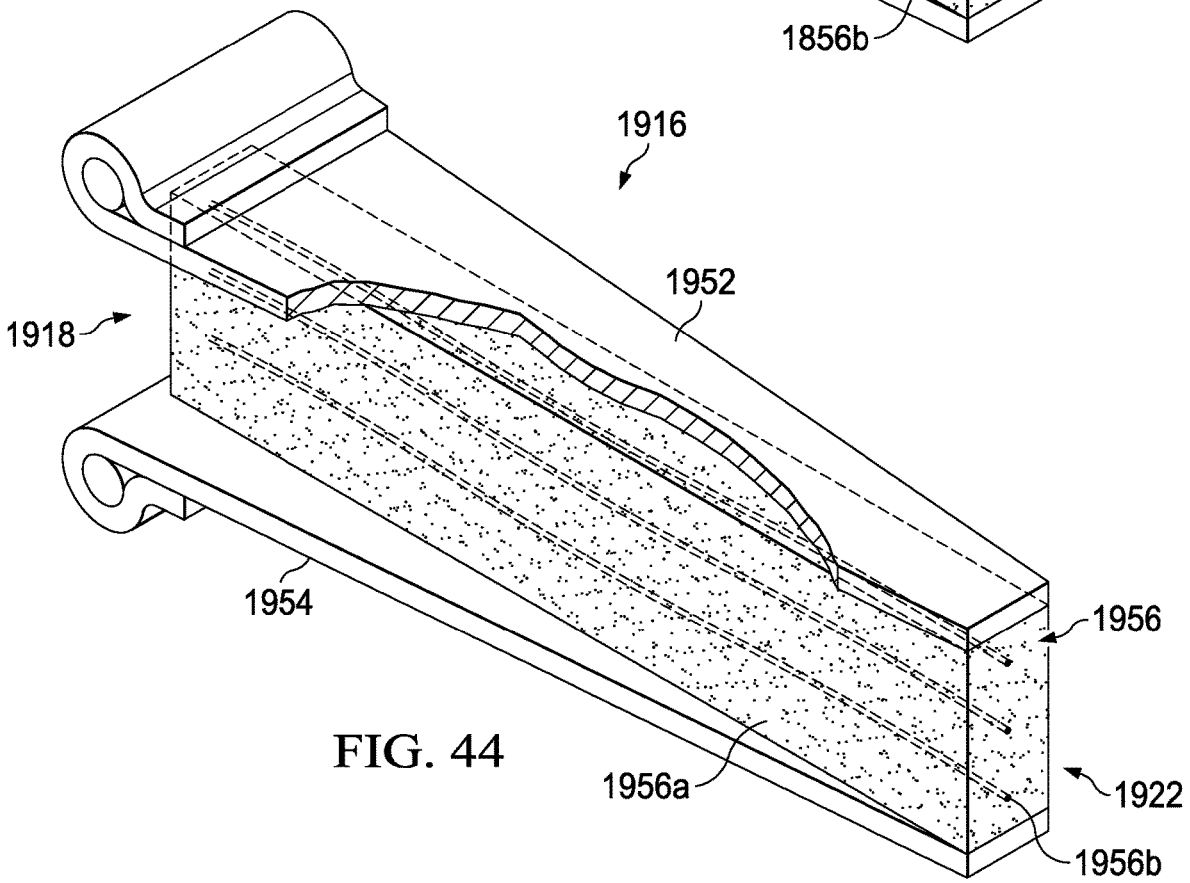
FIG. 44 is an enlarged front isometric view depicting a bow limb, in accordance with another embodiment, wherein an upper plate member is shown partially cut away for clarity of illustration.

FIG. 44 illustrates a bow limb 1916 that is similar to or the same as in many respects to the bow limb 1816 of FIG. 43 as, for example, the bow limb 1916 is shown to extend from a proximal end 1918 to a distal end 1922, and to include an upper plate member 1952, a lower plate member 1954, and a cushioning member 1956 sandwiched in between. The upper and lower plate members 1952, 1954 can be formed of a metal, metal alloy or other material(s), and each can be formed of like or different material(s) relative to one another. The cushioning member 1956 is shown to be formed from an elastomeric material 1956*a* that is reinforced by fibers 1956*b*. However, the fibers 1956*b* are shown in FIG. 44 to be long fibers (e.g., versus short fibers as 1856*b* of FIG. 43). Each of the fibers 1956*b* are shown in FIG. 44 to extend along the entire length, substantially the entire length, or at least a substantial length of the cushioning member 1956. It will be appreciated that, in one embodiment, each of the fibers throughout the entirety of the cushioning member can be formed of the same material and of uniform length and diameter. However, it will be appreciated that in other embodiments, fibers of varying materials, lengths and/or diameters can be included within a cushioning member.

In an alternative embodiment, a cushioning member can include both short fibers (e.g., of a type shown in FIG. 43) and long fibers (e.g., of a type shown in FIG. 44), where both the short and long fibers are formed of either like material or unlike materials. The fibers can be formed from any of a variety of suitable natural or synthetic materials such as glass, fiberglass, aramid, carbon, polyester and vectran. It will be appreciated that fibers within a cushioning member can be provided in any of a variety of suitable orientations such as having aligned fibers, partially aligned fibers and random fibers. It will be appreciated that inclusion of fibers in the cushioning member can facilitate a variety of desirable performance characteristics such as enhanced strength, increased stiffness, reduced density, and/or diminished weight.

Figure 4A:
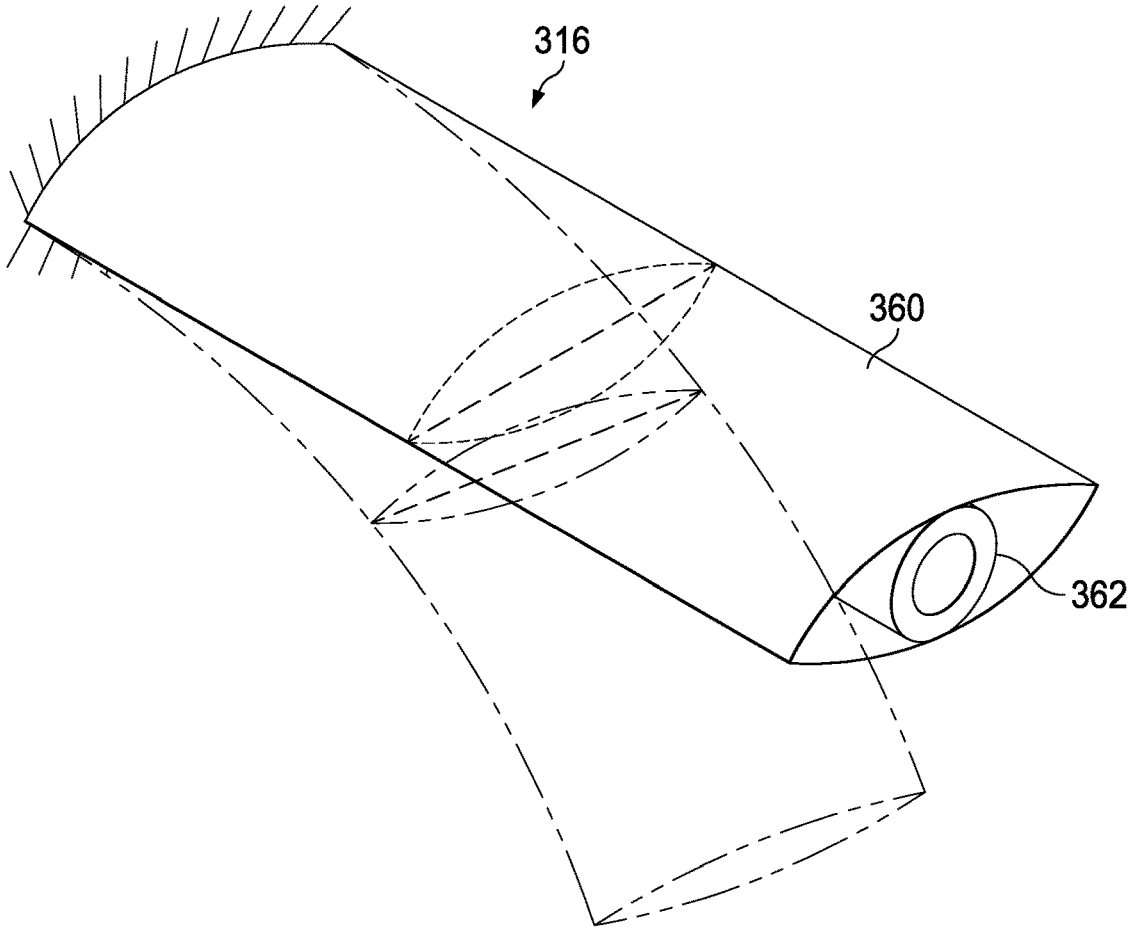
FIGS. 4A-4D are various views depicting a bow limb of a crossbow, in accordance with still yet another embodiment.
Figure 4B:
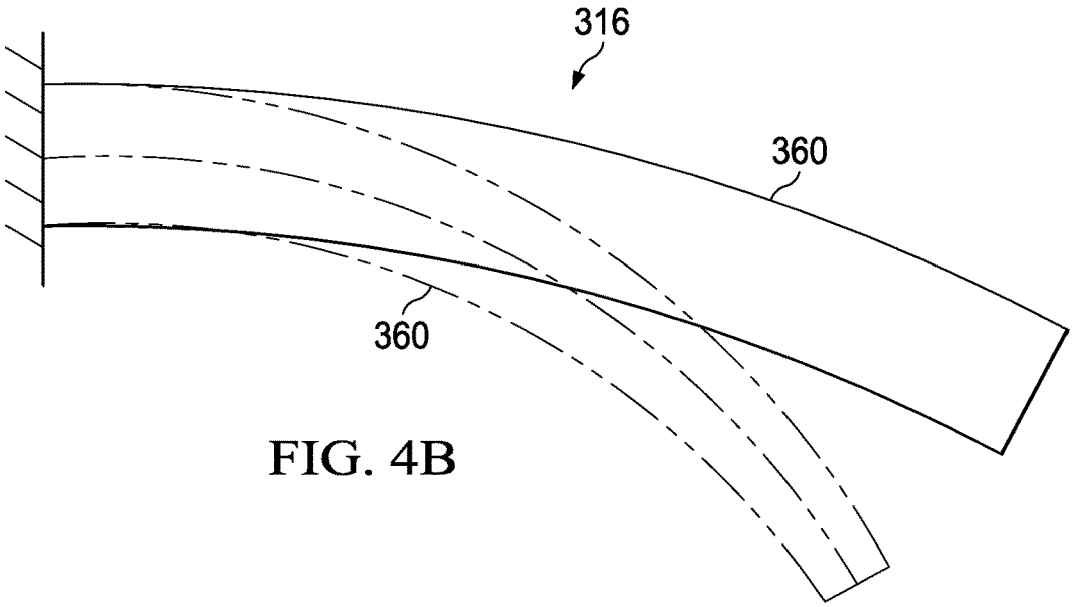
Figure 4C:
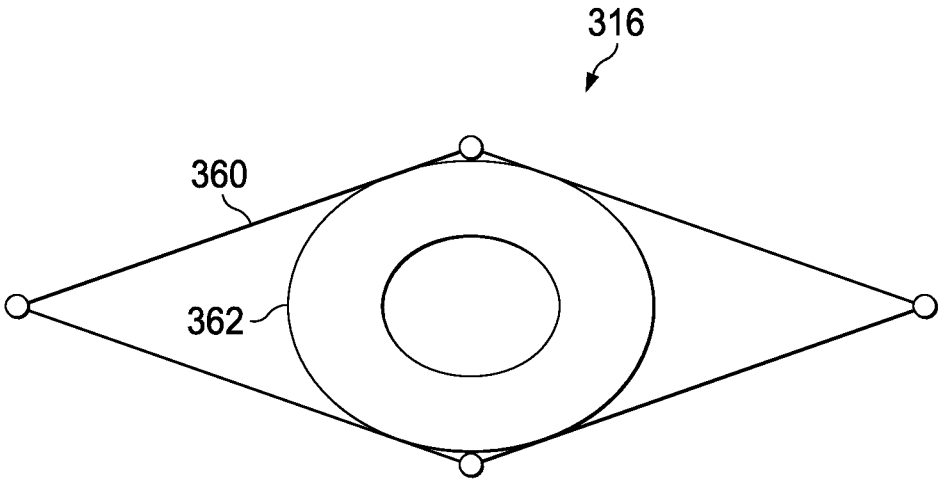
Figure 4D:
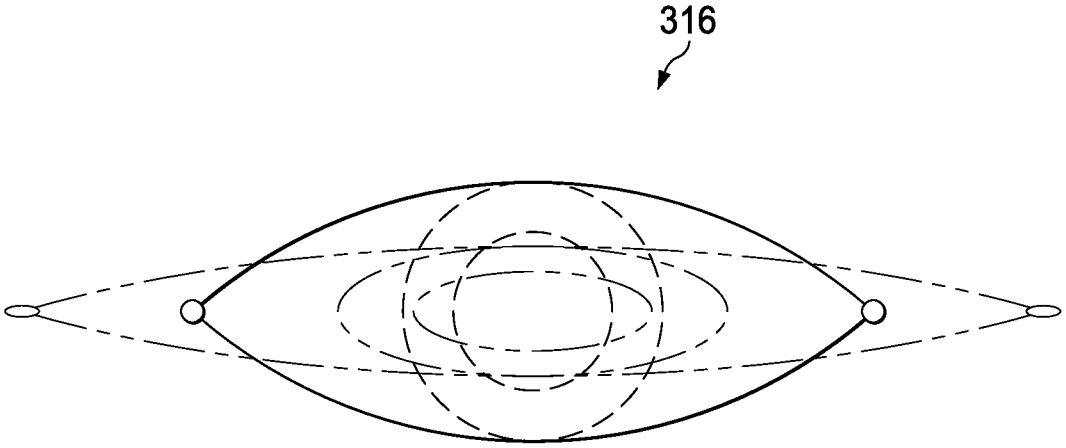

FIGS. 4A-4D illustrate an alternative embodiment of a bow limb 316 that is similar to or the same as in many respects as the bow limbs 16, 116 of FIGS. 1A-1E and 2A-2J, respectively. However, the bow limb 316 comprises an outer sheath 360 and an inner elongate rib member 362. As illustrated in FIGS. 4C and 4D, the outer sheath 360 and inner elongate rib member 362 can deform as the bow limb 316 moves towards the loaded position. More particularly, the inner elongate rib member 362 can collapse into a substantially flat arrangement (i.e., buckle) which can result in let-off during pullback. The inner elongate rib member 362 can also control the buckling of the outer sheath 360 so as to provide a desirable pull characteristic during pullback.

Figure 5:
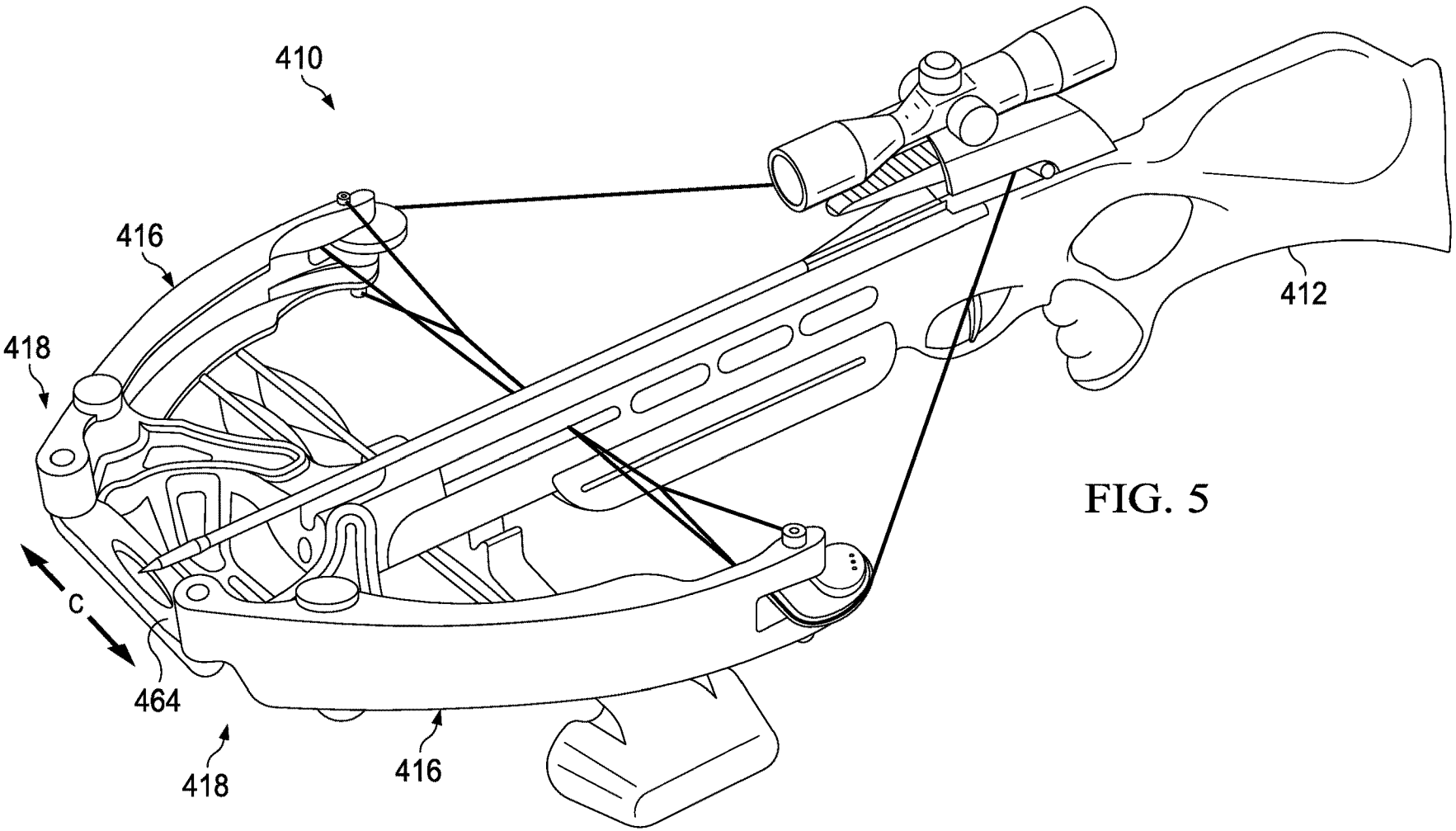
FIG. 5 is a front isometric view depicting a crossbow, in accordance with still yet another embodiment.
Figure 6:
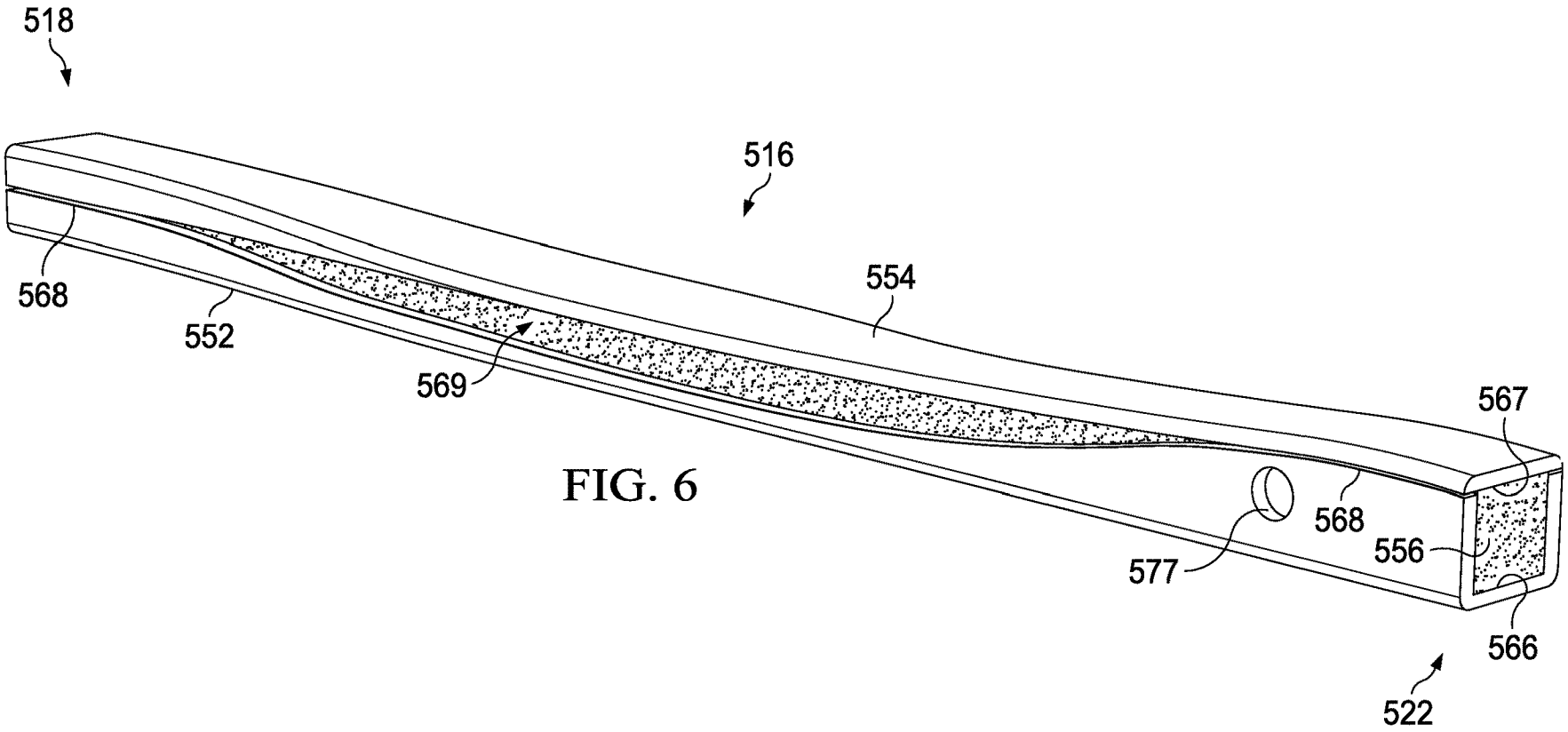
FIG. 6 is a side isometric view depicting a bow limb of a crossbow, in accordance with still yet another embodiment.
Figure 7:
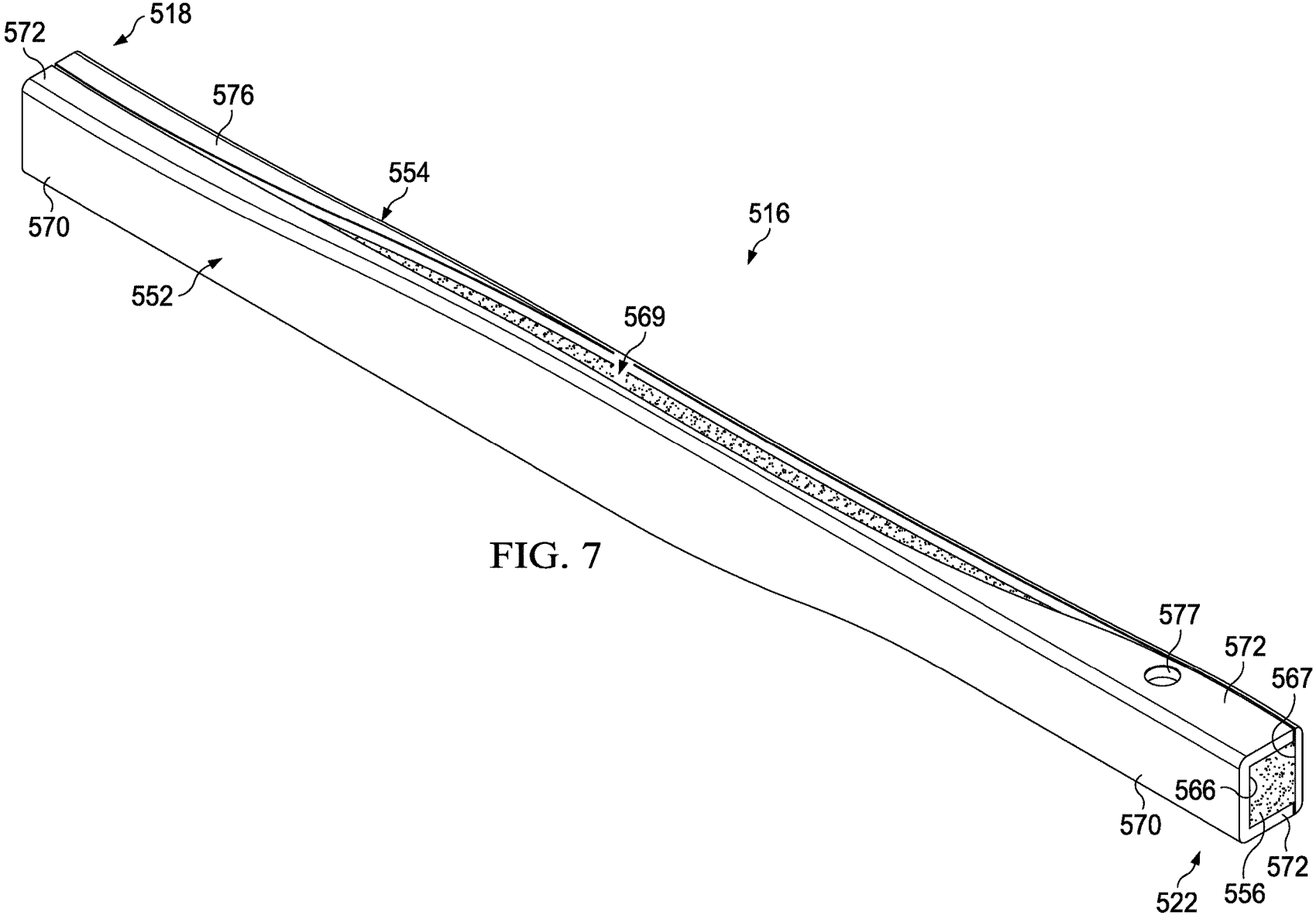
FIG. 7 is a top isometric view depicting the bow limb of FIG. 6.
Figure 8:
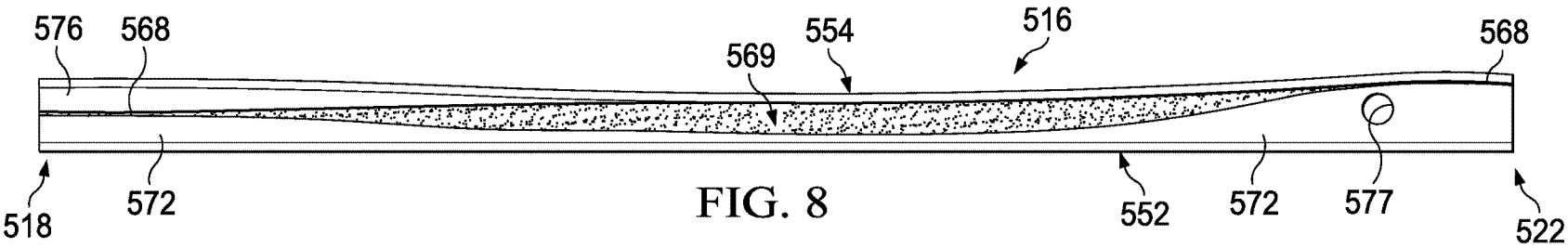
FIG. 8 is a left side view depicting the bow limb of FIG. 6.
Figure 9:
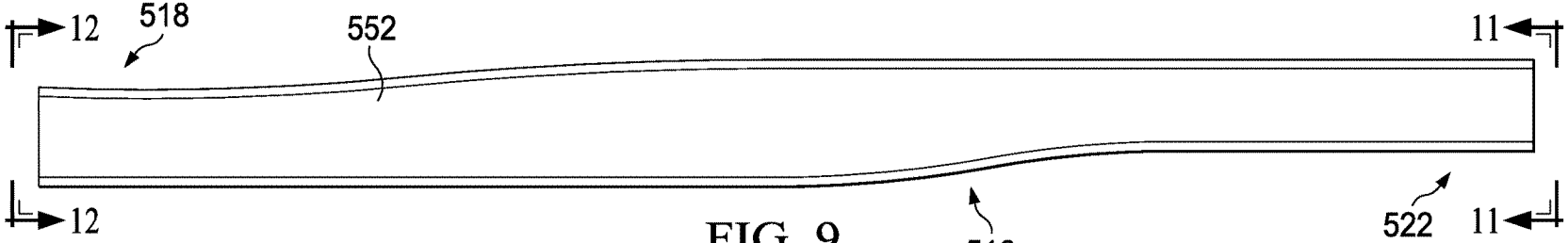
FIG. 9 is a bottom view depicting the bow limb of FIG. 6.
Figure 10:
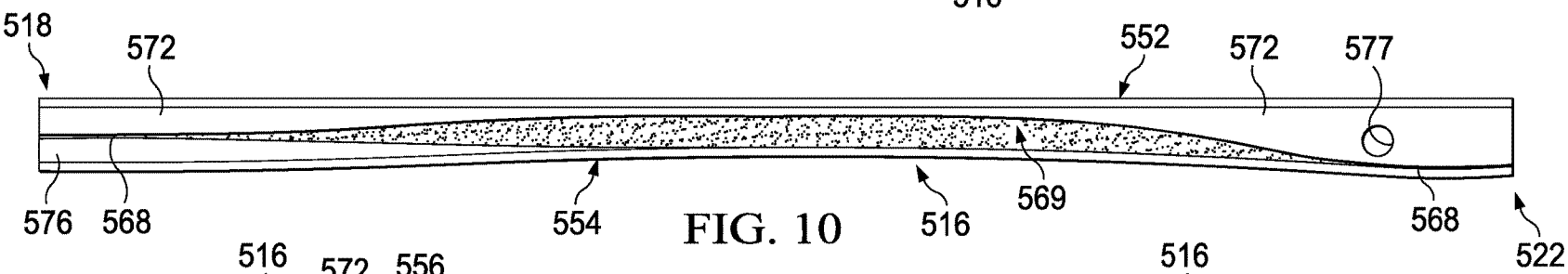
FIG. 10 is a right side view depicting the bow limb of FIG. 6.
Figure 12:
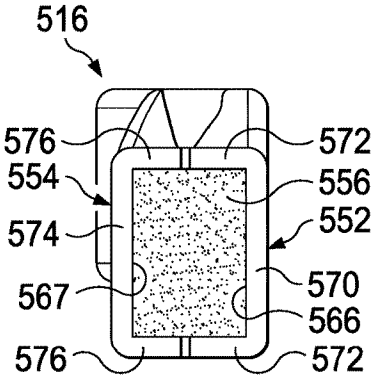
FIG. 12 is an end view depicting the bow limb of FIG. 6 taken from the perspective of line 12-12 in FIG. 9.
Figure 11:
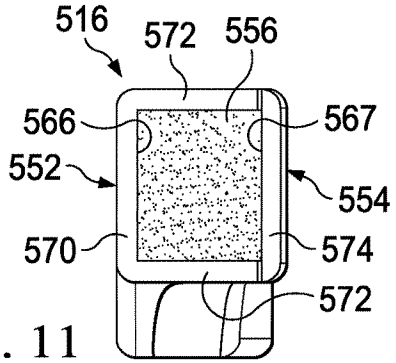
FIG. 11 is an end view depicting the bow limb of FIG. 6 taken from the perspective of line 11-11 in FIG. 9.

FIG. 5 illustrates an alternative embodiment of a crossbow 410 that is similar to or the same as in many respects as the crossbow 110 of FIG. 2A. For example, the crossbow 410 includes a stock 412 and a pair of bow limbs 416 pivotally coupled with the stock 412. The bow limbs 416, however, are coupled together with a resilient member 464 that facilitates biasing of the bow limbs 416 into the relaxed position. For example, as the bow limbs 416 are drawn into the loaded position, proximal ends 418 are drawn away from each other (in the direction of arrow C) thereby stretching the resilient member 464 such that the resilient member 464 biases the bow limbs 416 into the relaxed position.

FIGS. 6-12 illustrate an alternative embodiment of a bow limb 516 that extends between a proximal end 518 and a distal end 522. The bow limb 516 can include an outer elongate member 552, an inner elongate member 554, and a core member 556 sandwiched between the outer elongate member 552 and the inner elongate member 554. In one embodiment, the outer and inner elongate members 552, 554 can be formed of hardened metal, and the core member 556 can be formed of a rubber. The core member 556 can be coupled with respective interior surfaces 566, 567 of the outer elongate member 552 and the inner elongate member 554 such that the outer elongate member 552 and the inner elongate member 554 are coupled together via the core member 556. The core member 556 can be coupled to the respective interior surfaces 566, 567 of the outer and inner elongate members 552, 554 with adhesive or any of a variety of other suitable attachment methods.

The outer elongate member 552 and the inner elongate member 554 can interface with each other at a seam 568. The outer and inner elongate members 552, 554 can be detached from each other along the seam 568 such that the outer elongate member 552 and the inner elongate member 554 are permitted to slide relative to each other when the bow limb 516 is bent (as will be described in further detail below with respect to FIGS. 24 and 26). Referring now to FIGS. 6-8 and 10, the outer and inner elongate members 552, 554 can cooperate to define a lateral opening 569 that is disposed between the proximal end 518 and the distal end 522 and through which the core member 556 is exposed. The lateral opening 569 allows for the outer and inner elongate members 552, 554 to compress together at the lateral opening 569 without interfering with each other when the bow limb 516 is bent (as will be described in further detail below with respect to FIGS. 24 and 26).

It is to be appreciated that the outer and inner elongate members 552, 554 can be formed of other metals, such as beryllium, copper, and/or titanium or any of a variety of other suitable materials that are stiffer than the material of the core member 556. It is also to be appreciated that the core member 556 can be formed of any of a variety of elastomeric materials and/or other suitable materials that are less stiff than the material of the outer and inner elongate members 552, 554.

Referring now to FIGS. 6, 7, 11 and 12, the outer elongate member 552 can be substantially c-shaped at each of the proximal end 518 and the distal end 522. In particular, the outer elongate member 552 can have a central member 570 and a pair of leg members 572 that extend from and cooperate with the central member 570 to define a c-shaped portion at each of the proximal and distal ends 518, 522. The inner elongate member 554 can be substantially c-shaped at the proximal end 518. In particular, the inner elongate member 554 can have a central member 574 and a pair of leg members 576 (FIG. 12) that extend from and cooperate with the central member 574 to define a c-shaped portion at the proximal end 518. The core member 556 can be disposed within each of the c-shaped portions when attached to the outer and inner elongate members 552, 554. In one embodiment, the core member 556 can be coupled with the respective interior surfaces 566, 567 located at the central members 570, 574 of the respective outer and inner elongate members 552, 554. In such an embodiment, the core member 556 can be detached from the respective interior surfaces 566, 567 (e.g., devoid of adhesive) of the outer and inner elongate members 552, 554 at the respective leg members 572, 576. It is to be appreciated that any of a variety of configurations are contemplated for the outer elongate member and the inner elongate member. For example, in one alternative configuration, the inner elongate member and/or the outer elongate member might be a substantially flat steel member that is substantially devoid of any c-shaped portions (see, for example, FIGS. 3A-3C).

Referring now to FIGS. 6-8 and 10, the distal end 522 of the bow limb 516 can define a through hole 577 that facilitates rotatable coupling of a cam (e.g., 514 in FIG. 13) to the distal end 522 of the bow limb 516. The through hole 577 can extend through each of the leg members 572 of the outer elongate member 552 and through the core member 556.

Figure 13:
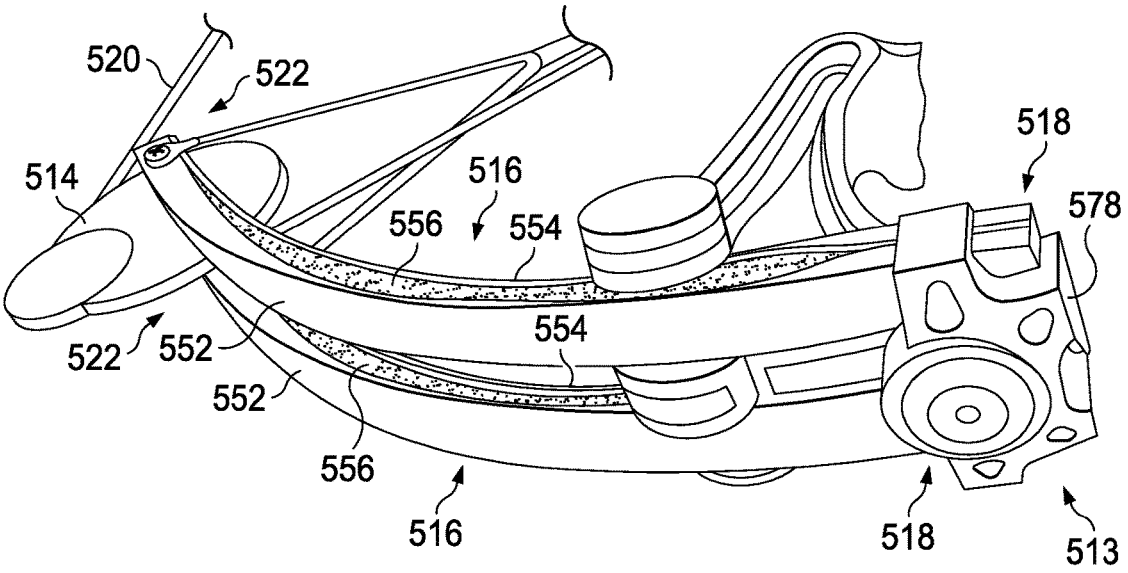
FIG. 13 is a front isometric view depicting a portion of a right side of a crossbow that incorporates two bow limbs of FIG. 6.

Referring now to FIG. 13, a portion of a right side of a crossbow is shown that incorporates a pair of the bow limbs 516 illustrated in FIGS. 6-12. The proximal ends 518 of each of the bow limbs 516 can be coupled to a front end 513 of the crossbow with a riser 578. A cam 514 can be rotatably coupled to the distal ends 522 of the pair of bow limbs 516 (e.g., via the through holes 577) and a bow string 520 can be routed around the cam 514 which can facilitate firing of a bolt (e.g., an arrow) from the crossbow. It is to be appreciated that another pair of the bow limbs 516 can be incorporated into a left side of the crossbow that is effectively a mirror image of what is shown in FIG. 13 and that cooperates with the bow limbs 516 on the right side to facilitate firing of a bolt from the crossbow.

The bow limbs 516 can be arranged on the crossbow such that the outer elongate members 552 of one pair of bow limbs 516 faces away from the outer elongate members 552 of the other pair of bow limbs 516, and the inner elongate members 554 of one pair of bow limbs 516 faces the inner elongate members 554 of the other pair of bow limbs 516. When a bolt is loaded into the crossbow and pulled rearwardly (e.g., in the direction of arrow P in FIG. 1A), the bow limbs 516 can be bent into a loaded position. Bending of the bow limbs 516 into the loaded position can cause the outer elongate members 552 of each bow limbs 516 to slide with respect to each other, thus causing the core member 556 to become deformed (see for example FIGS. 21-24). The stiffness of the outer and inner elongate members 552, 554 cooperates with the deformation of the core member 556 to effectively resist the bending of the bow limbs 516 into the loaded position. As a result, when the crossbow is released, the bow limbs 516 can straighten out, thus releasing the tension in bow limbs 516 to release the bolt from the crossbow 510.

The bow limbs 516 can perform as well or better than conventional fiber reinforced plastic (FRP) bow limbs and can thus serve as a cost effective replacement for those conventional bow limbs (e.g., during manufacturing of a crossbow or as a retrofit for an existing cross bow). For example, the materials used to manufacture the outer and inner elongate members 552, 554 and the core member 556 (e.g., steel and rubber, respectively) is typically more readily available and less expensive than FRP. In addition, the manufacturing process for those materials is less complicated than FRP, and in some cases, can be simple enough for a cross bow manufacturer to perform rather than relying on a third party bow limb manufacturer, as is typically the case with manufacturing bow limbs out of FRP. The materials and manufacturing process of the bow limbs 516 can yield more predictable results. For example, the characteristics of the materials that might affect the performance of the bow limbs (e.g., thickness, stiffness, imperfections) are more easily controlled than FRP. In addition, the overall structure of the bow limbs is such that the performance of the bow limbs is less susceptible to being affected by slight variability in the material characteristics. This consistency among the bow limbs can alleviate the need to test each bow limb and match it with a similar performing bow limb (e.g., sorting), as is typical with FRP bow limbs, which can be time consuming and inefficient.

The testing methodology for arriving at the overall design of the bow limb 516 illustrated in FIGS. 6-13 will now be discussed. First, a conventional FRP bow limb was repeatedly tested during use in a crossbow to understand the various performance metrics (e.g., stress, strain, deflection, etc.) that the FRP bow limb was subjected to during use. Analyzing the data from this testing revealed that a significant amount of stress and strain occurred at the outside layer of the conventional FRP bow limb during bending. Using that data, a sandwiched arrangement having outer and inner metal layers spaced apart by a pliable core and slidable relative to each other was selected as a possible alternative arrangement (one example of such an arrangement is illustrated in FIGS. 3A-3D). Various materials were then explored for the outer and inner metal layers and the pliable core to determine whether there was a suitable composition for each component that would yield a low cost, predictable, easy to manufacture bow limb as an alternative to the conventional FRP bow limb. Through testing and/or modeling, certain metals, such as high strength steel, beryllium copper, and titanium, for example, were determined to be suitable for the outer and inner metal layers, and an elastomeric material, such as a rubber having a modulus of between about 1 kilopound per square inch (KSI) and about 10 KSI, was determined to be suitable for the elastomeric material. It is to be appreciated however, that other suitable metals and elastomeric materials were contemplated and found to be suitable.

Once the general design and materials were selected, the particular configuration of the outer and inner metal layers (e.g., shape, thickness, and length) as well as the configuration of the elastomeric material could then be designed (e.g., engineered) to achieve a desired stiffness (e.g., force divided by distance) for the bow limb 516. As such, bow limbs (e.g., 516) with different stiffnesses can be provided to accommodate the various skill levels of users.

Figure 14:
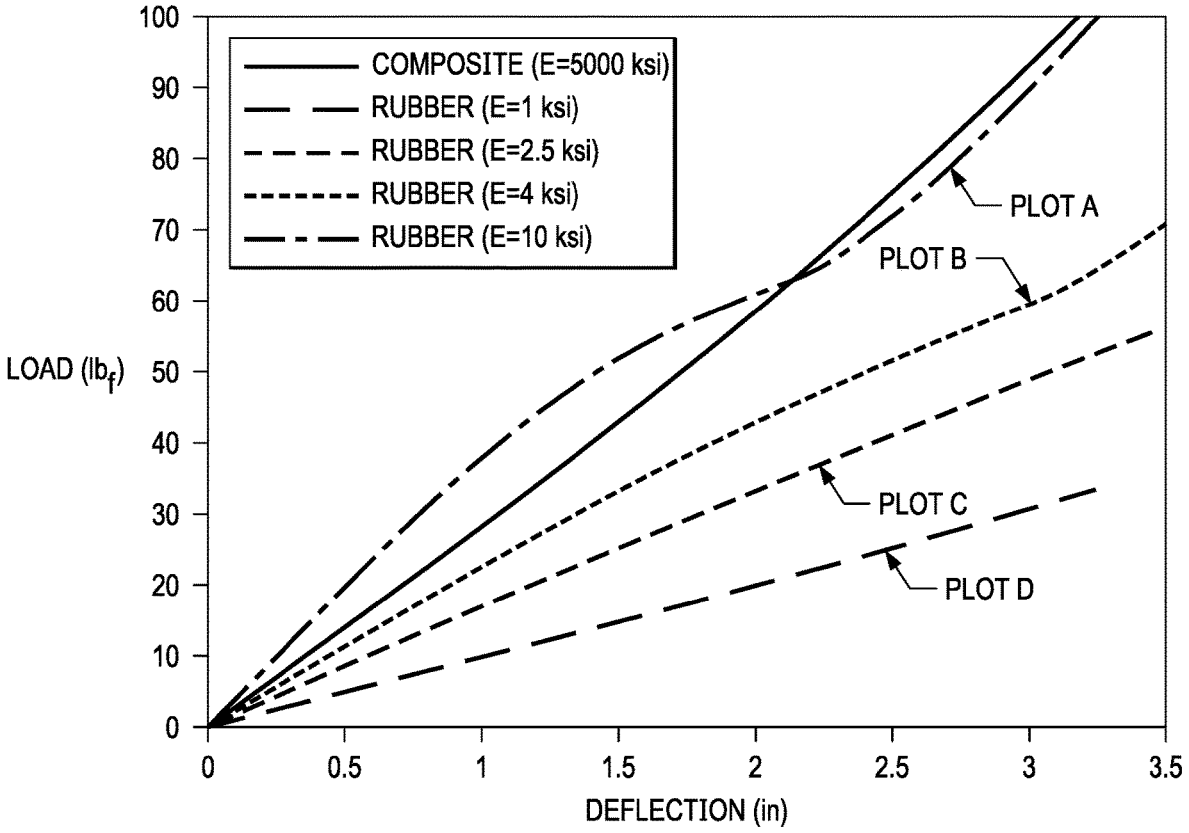
FIG. 14 is a plot depicting the relationship between a load provided to the bow limb of FIG. 6 and the resulting deflection of the bow limb.
Figure 15:
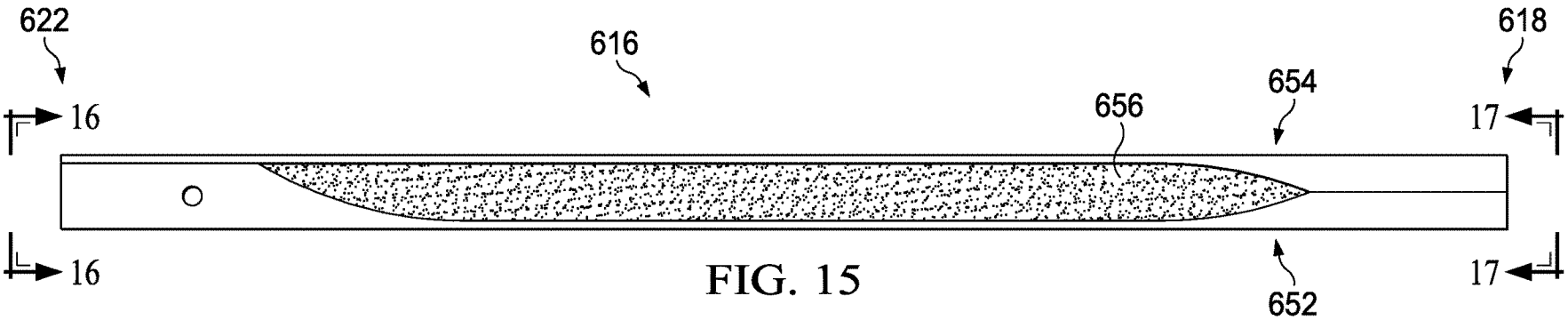
FIG. 15 is a side view depicting a bow limb of a crossbow, in accordance with still yet another embodiment.

Referring now to FIG. 14, a plot is illustrated that depicts one example of the relationship between a load provided to the distal ends 522 of the bow limb 516 (in pounds of force) and the resulting deflection of the bow limb 516 (in inches) for various modulus values of the core member 556 as compared to a conventional FRP bow limb. The response of the conventional FRP bow limb is shown in a solid line. The response of the bow limb 516 is shown by the other plots on the graph. The plot can be understood to illustrate how the modulus of the core member 556 can be selected to match the response of the conventional FRP bow limb as well as how different modulus values affect the response of the bow limb 516 without changing the outer and inner elongate members 552, 554. The plot can be also be understood to illustrate how different modulus values can be selected for the core member 556 of the bow limb 516 to provide a different response (e.g., for users of different skill levels).

For example, a core member 556 having a modulus of about 10 KSI can have a response (identified as Plot A) that closely resembles the response of the conventional FRP bow limb. However, as the modulus of the core member 556 is decreased, the relationship between the load provided to the distal ends 522 of the bow limb 516 and the resulting deflection of the bow limb 516 decreases. When the bow limb 516 is provided with a modulus value of about 4 KSI, the response of the bow limb 516 to load (identified as Plot B) is still substantially constant (e.g., the slope of the plot is substantially straight), however, the bow limb 516 does not deflect as much under the same load as the bow limb 516 having a core member 556 with a modulus value of about 10 KSI. When the bow limb 516 is provided with a modulus value of about 2.5 KSI, the response of the bow limb 516 (identified as Plot C) to load is still substantially constant (e.g., the slope of the plot is substantially straight), however, the bow limb 516 does not deflect as much under the same load as the bow limb 516 having a core member 556 with a modulus value of about 4 KSI. When the bow limb 516 is provided with a modulus value of about 1 KSI, the response of the bow limb 516 (identified as Plot D) to load is still substantially constant (e.g., the slope of the plot is substantially straight), however, the bow limb 516 does not deflect as much under the same load as the bow limb 516 having a core member 556 with a modulus value of about 2.5 KSI.

It is to be appreciated that the plot illustrated in FIG. 14 can also be understood to illustrate how manufacturing tolerances in the modulus of the core member 556 (e.g., material characteristics) do not significantly adversely affect the performance of the bow limb 516. For example, the modulus of the core member 556 might vary slightly (along the length of the core member 556) due to manufacturing tolerances. However, these variations in the modulus are typically within the range of between about 0.1 and about 10 PSI and thus not significant enough (relative to plots B-D) to adversely affect the overall performance of the bow limb 516.

Figure 17:
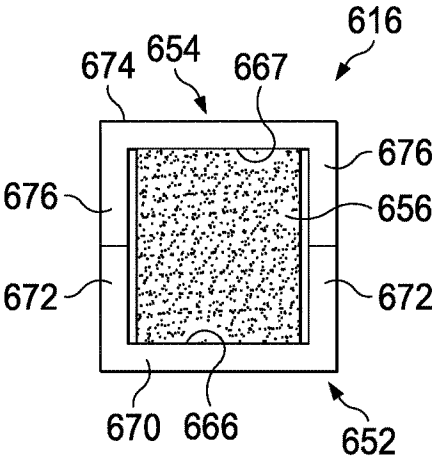
FIG. 17 is an end view depicting the bow limb of FIG. 15 taken from the perspective of line 17-17 in FIG. 15.
Figure 16:
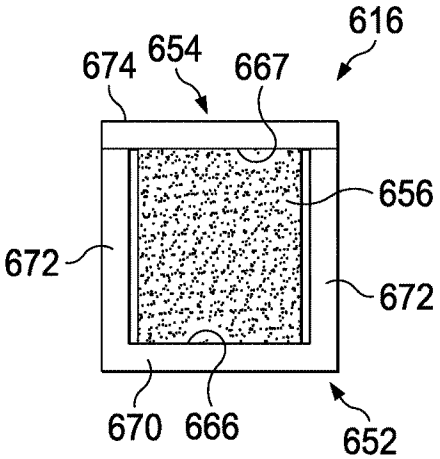
FIG. 16 is an end view depicting the bow limb of FIG. 15 taken from the perspective of line 16-16 in FIG. 15.

FIGS. 15-22 illustrate an alternative embodiment of a bow limb 616 that is similar to or the same in many respects as the bow limb 516 illustrated in FIGS. 6-13. For example, the bow limb 616 can extend between a proximal end 618 and a distal end 622 and can include an outer elongate member 652, an inner elongate member 654, and a core member 656 that is sandwiched between the outer and inner elongate members 652, 654. As illustrated in FIGS. 16 and 17, the core member 656 can be coupled with respective interior surfaces 666, 667 located at central members 670, 674 of the respective outer and inner elongate members 652, 654. In such an embodiment, the core member 656 can be detached from the respective interior surfaces 666, 667 (e.g., devoid of adhesive) of the outer and inner elongate members 652, 654 at respective leg members 672, 676.

Figure 18:
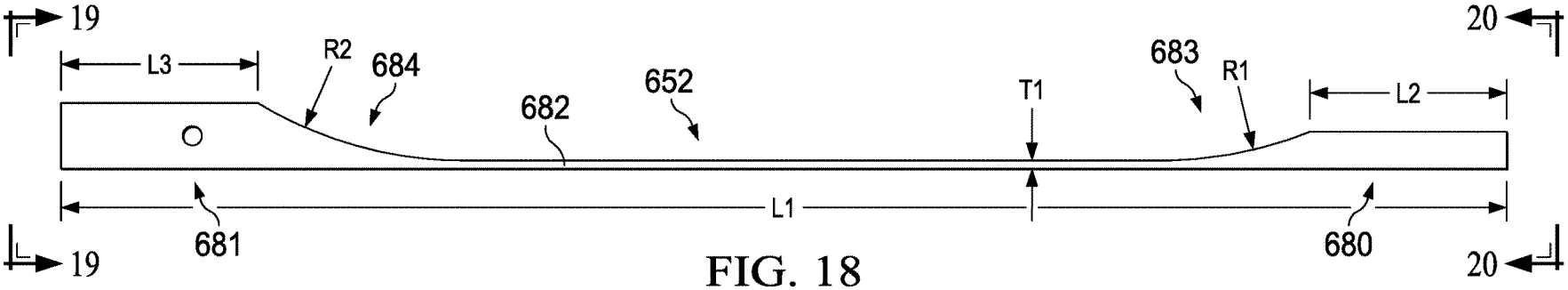
FIG. 18 is a side view depicting an outer elongate member of the bow limb of FIG. 15.

Referring now to FIG. 18, the outer elongate member 652 is shown to include a proximal end portion 680, a distal end portion 681, and a central portion 682 disposed between the proximal and distal end portions 680, 681. The outer elongate member 652 can have a length L1. The proximal end portion 680 can have a length L2, the distal end portion 681 can have a length L3, and the central portion 682 can have a thickness T1. In one embodiment, the length L1 can be about 11 inches, the length L2 can be about 1.5 inches, the length L3 can be about 1.5 inches, and the thickness T1 can be about 0.062 inches.

The outer elongate member 652 is shown to include a proximal transition portion 683 and a distal transition portion 684. The proximal transition portion 683 can extend between the proximal end portion 680 and the central portion 682 and is shown to have a radius of curvature R1. The distal transition portion 684 can extend between the distal end portion 681 and the central portion 682 and is shown to have a radius of curvature R2. In one embodiment, the radii of curvature R1 and R2 can be about 3 inches. It is to be appreciated that the area between the proximal end portion 680 and the distal end portion 681 can at least partially define a lateral opening (e.g., 569, FIG. 6) for the bow limb 616.

Figure 20:
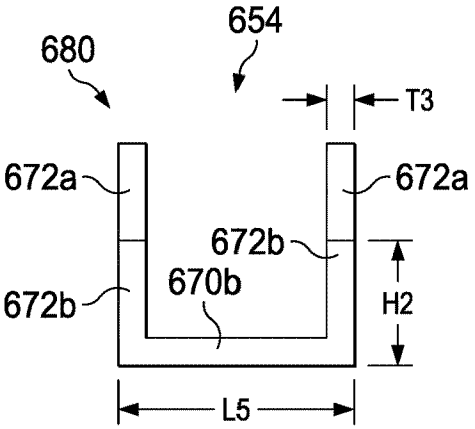
FIG. 20 is an end view depicting the outer elongate member of FIG. 18 taken from the perspective of line 20-20 in FIG. 18.
Figure 19:
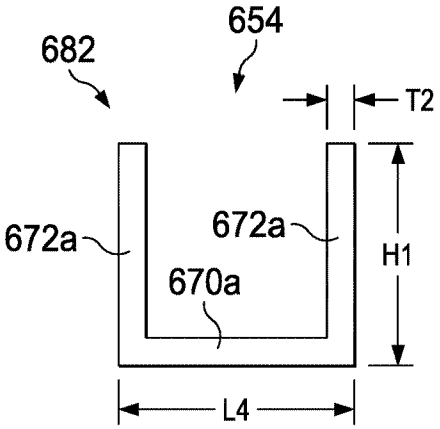
FIG. 19 is an end view depicting the outer elongate member of FIG. 18 taken from the perspective of line 19-19 in FIG. 18.

Referring now to FIG. 19, the distal end portion 681 is shown to have a central member 670*a* and a pair of leg members 672*a* that extend therefrom. The central member 670*a* can have a length L4, the leg members 672*a* can have a height H1 and a thickness T2. In one embodiment, the length L4 can be about 0.531 inches, the height H1 can be about 0.5 inches and the thickness T2 can be about 0.062 inches. Referring now to FIG. 20, the proximal end portion 680 is shown to have a central member 670*b* and a pair of leg members 672*b* that extend therefrom. The central member 670*b* can have a length L5, the leg members 672*b* can have a height H2 and a thickness T3. In one embodiment, the length L5 can be about 0.531 inches, the height H2 can be about 0.219 inches and the thickness T3 can be about 0.062 inches.

Figure 21:
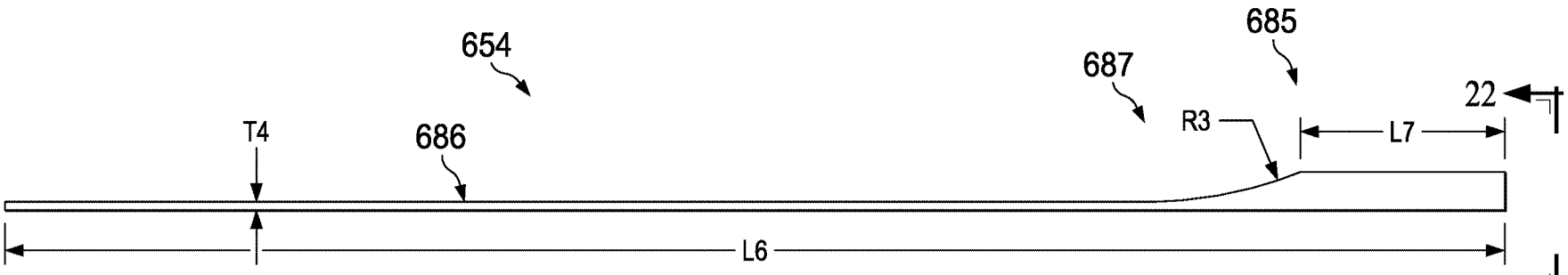
FIG. 21 is a side view depicting an inner elongate member of the bow limb of FIG. 15.

Referring now to FIG. 21, the inner elongate member 654 is shown to include a proximal end portion 685 and a distal end portion 686. The inner elongate member 654 can have a length L6. The proximal end portion 685 can have a length L7 and the distal end portion 686 can have a thickness T4. In one embodiment, the length L6 can be about 11 inches, the length L7 can be about 1.5 inches, and the thickness T4 can be about 0.062 inches. The inner elongate member 654 is shown to include a proximal transition portion 687 that extends between the proximal end portion 685 and the distal end portion 686. The proximal transition portion 687 is shown to have a radius of curvature R3. In one embodiment, the radius of curvature R3 can be about 3 inches.

Figure 22:
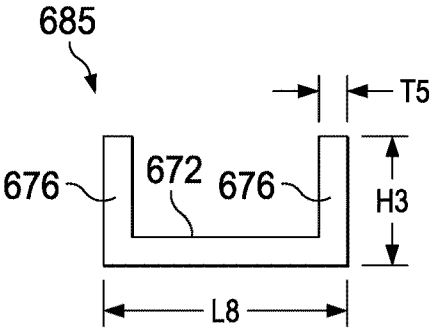
FIG. 22 is an end view depicting the inner elongate member of FIG. 21 taken from the perspective of line 22-22 in FIG. 21.

Referring now to FIG. 22, the proximal end portion 685 is shown to have a central member 672 and a pair of leg members 676 that extend therefrom. The central member 672 can have a length L8, the leg members 676 can have a height H3 and a thickness T5. In one embodiment, the length L8 can be about 0.531 inches, the height H3 can be about 0.219 inches and the thickness T5 can be about 0.062 inches. It is to be appreciated that the dimensions of the bow limb 616 described above should be understood to be one example of many different dimensions that are contemplated.

Figure 23:
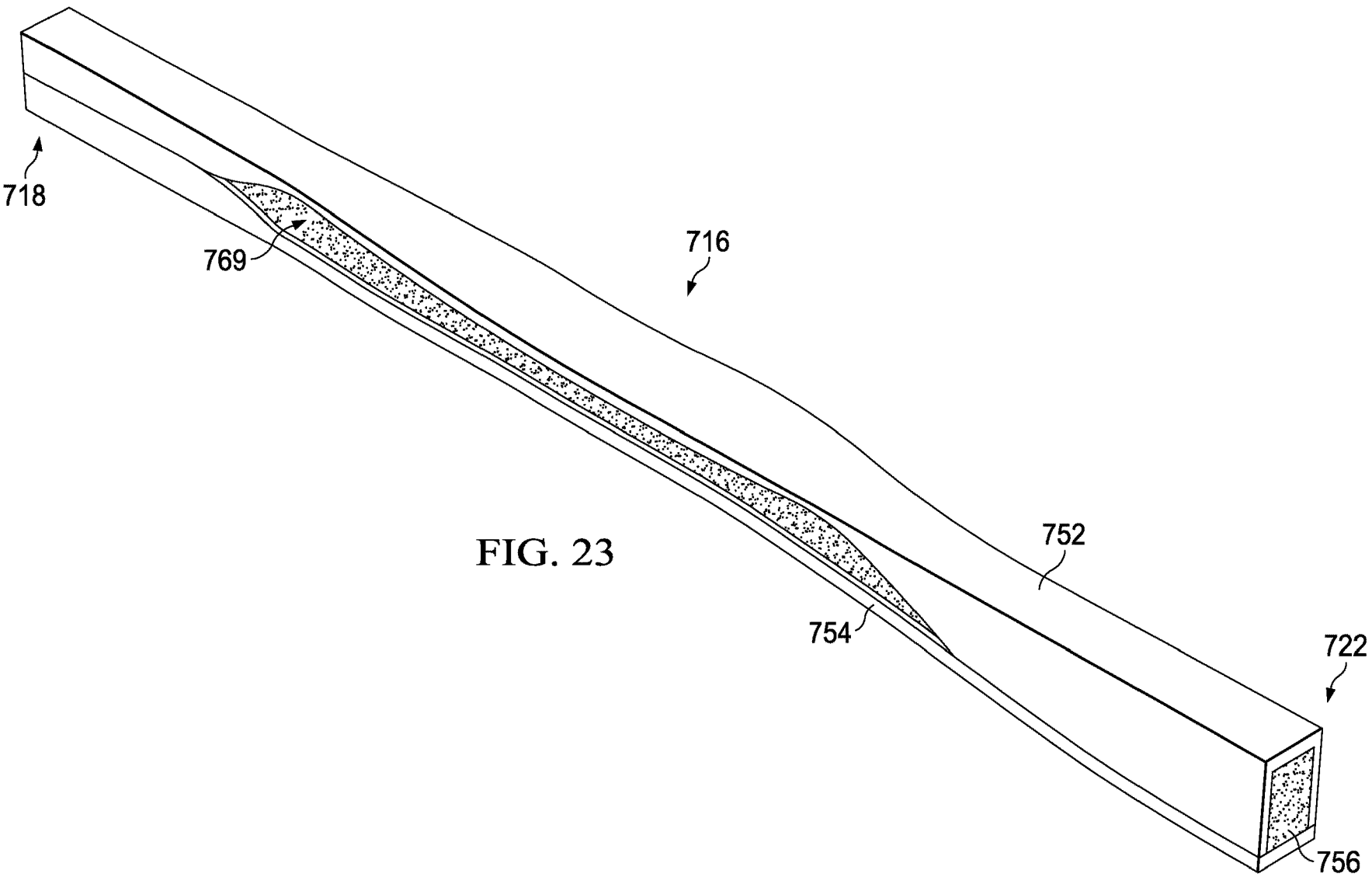
FIG. 23 is a side isometric view depicting a bow limb of a crossbow, in accordance with still yet another embodiment.
Figure 24:
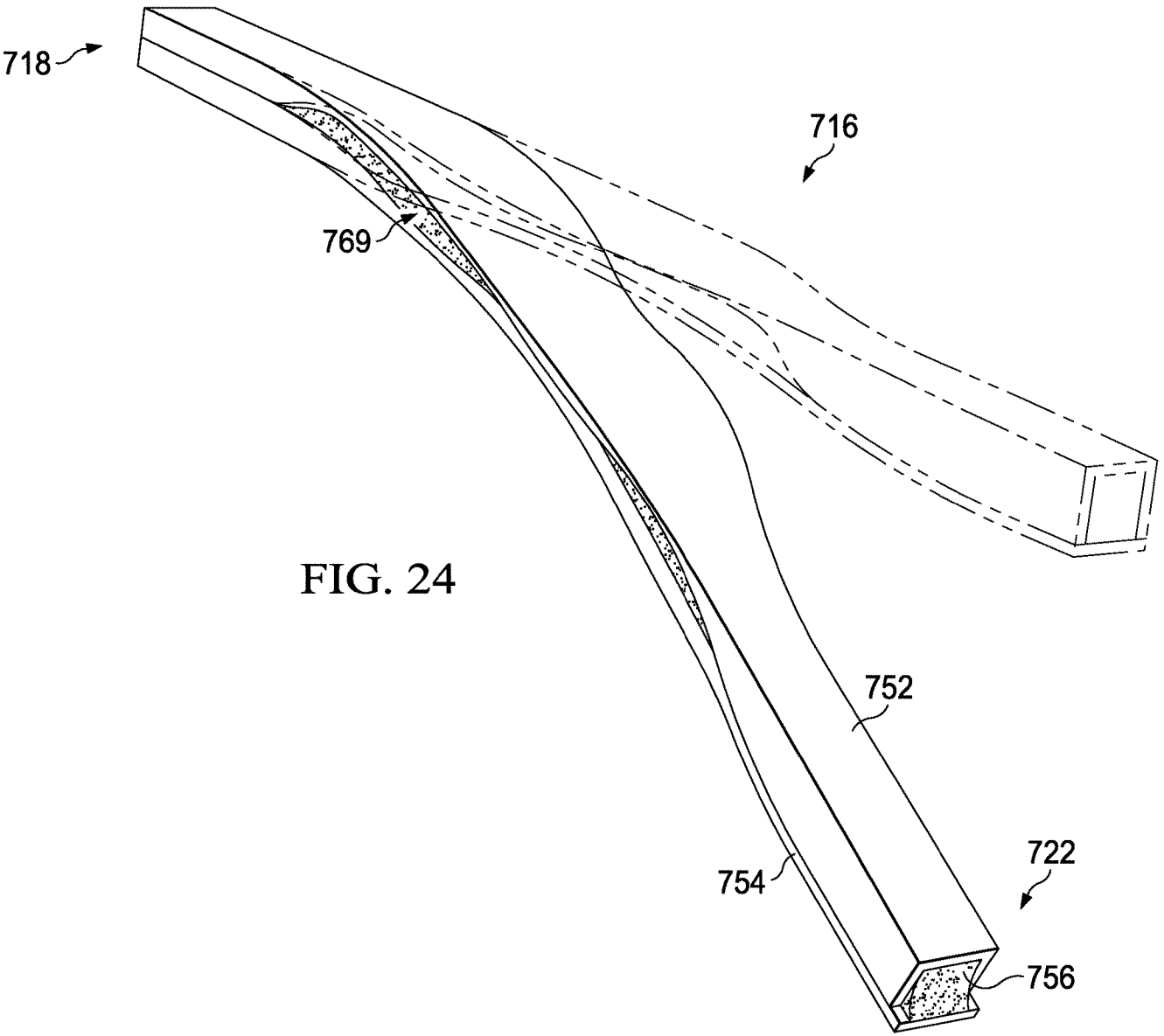
FIG. 24 is a side isometric view of the bow limb of FIG. 23 in each of a straightened position and a bent position.

FIGS. 23 and 24 illustrate another alternative embodiment of a bow limb 716 that is similar to or the same in many respects as the bow limb 516 illustrated in FIGS. 6-13. For example, the bow limb 716 can extend between a distal end 718 and a proximal end 722 and can include an outer elongate member 752, an inner elongate member 754, and a core member 756 that is sandwiched between the outer and inner elongate members 752, 754. As illustrated in FIG. 24, when the bow limb 716 is bent from an unloaded position (shown in solid lines) to a loaded position (shown in dashed lines), the outer and inner elongate members 752, 754 can compress together at a lateral opening 769, and the inner elongate member 754 can slide laterally with respect to the outer elongate member 752 such that a portion of the inner elongate member 754 can extend beyond the outer elongate member 752. The core member 756 can become deformed where the inner elongate member 754 extends beyond the outer elongate member 752, which can allow for such sliding of the inner elongate member 754 relative to the outer elongate member 752.

Figure 25:
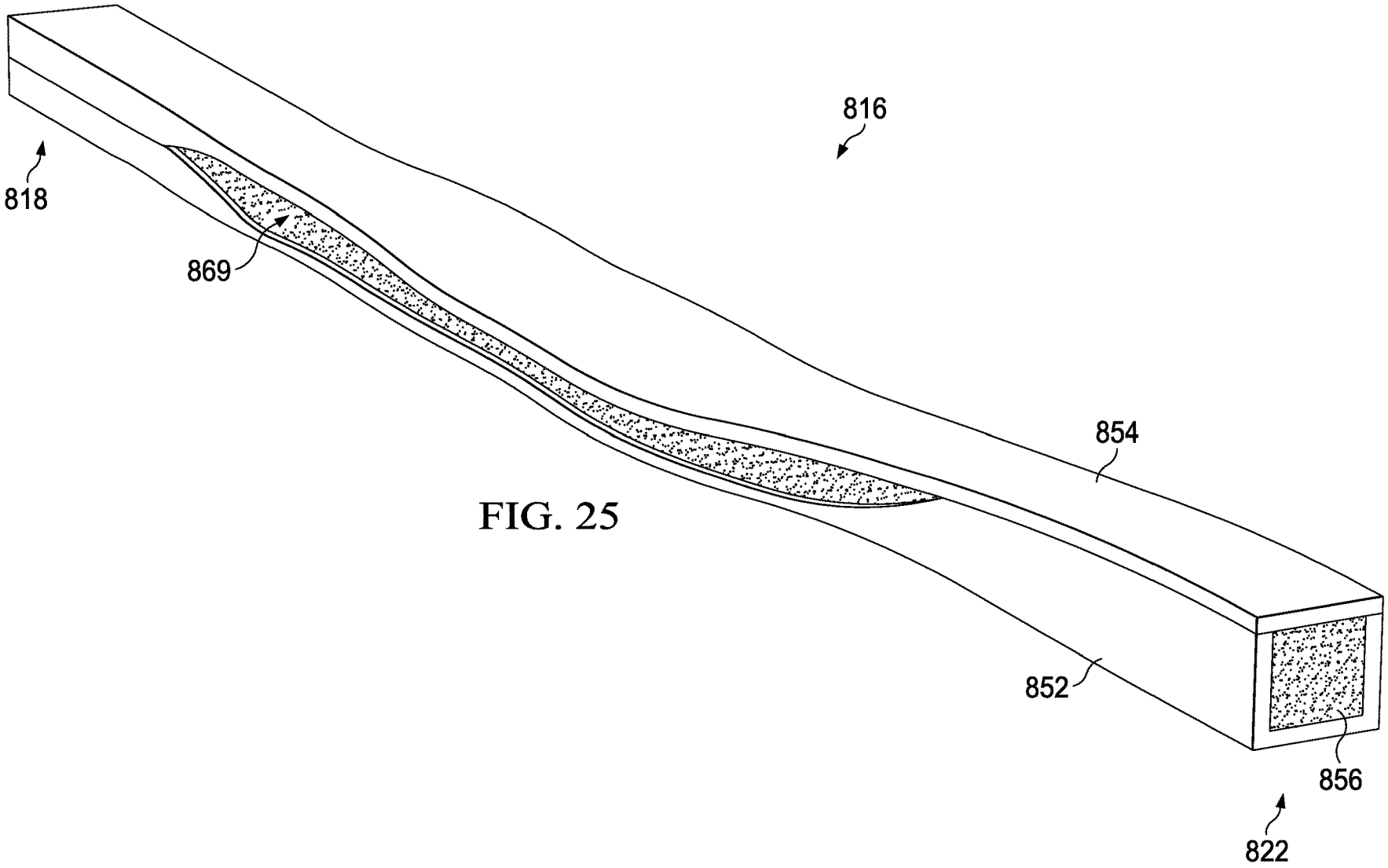
FIG. 25 is a side isometric view depicting a bow limb of a crossbow, in accordance with still yet another embodiment.
Figure 26:
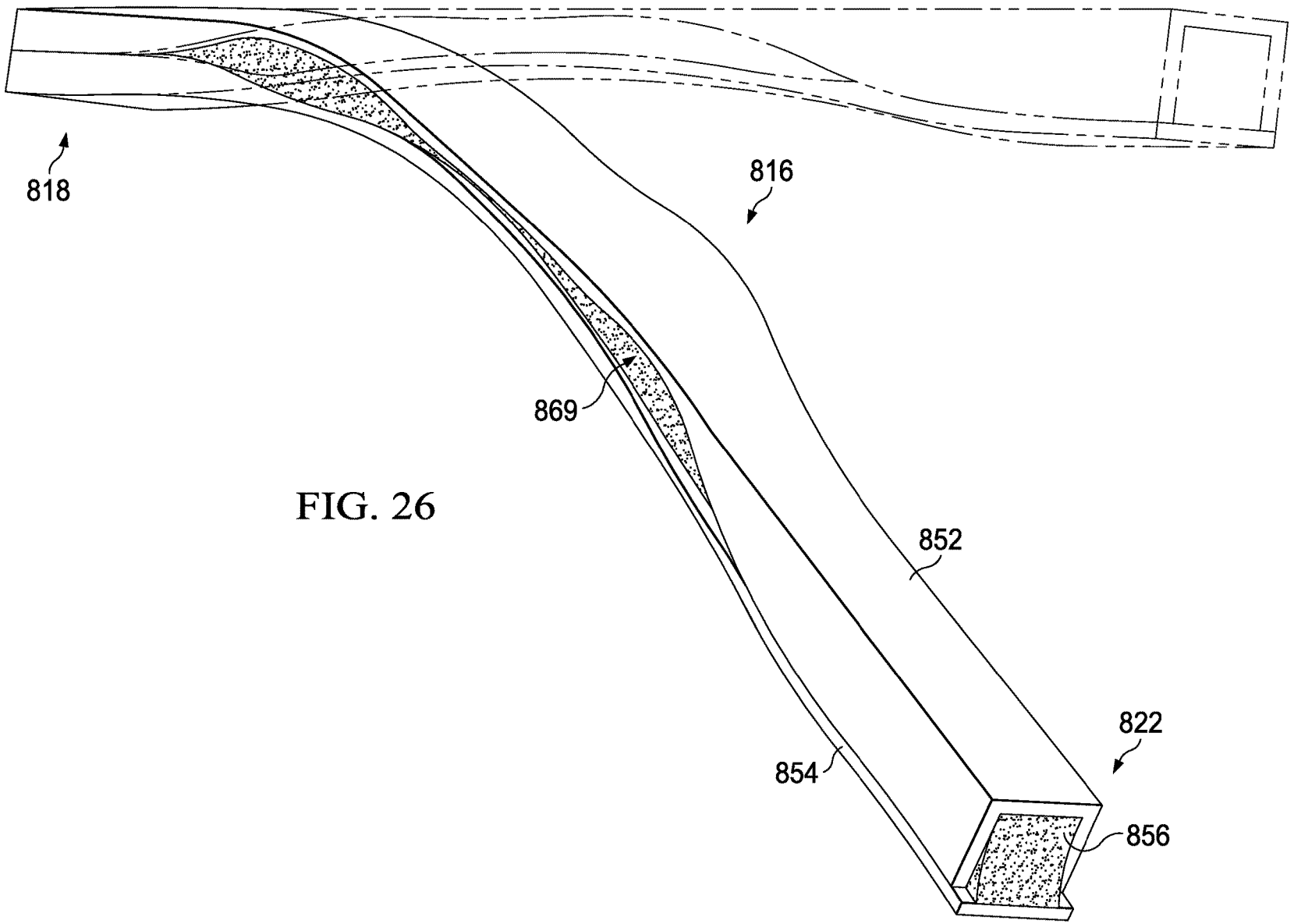
FIG. 26 is a side isometric view of the bow limb of FIG. 25 in each of a straightened position and a bent position.

FIGS. 25 and 26 illustrate yet another alternative embodiment of a bow limb 816 that is similar to or the same in many respects as the bow limb 716 illustrated in FIGS. 23 and 24. For example, the bow limb 816 can extend between a distal end 818 and a proximal end 822 and can include an outer elongate member 852, an inner elongate member 854, and a core member 856 that is sandwiched between the outer and inner elongate members 852, 854.

Figure 27:
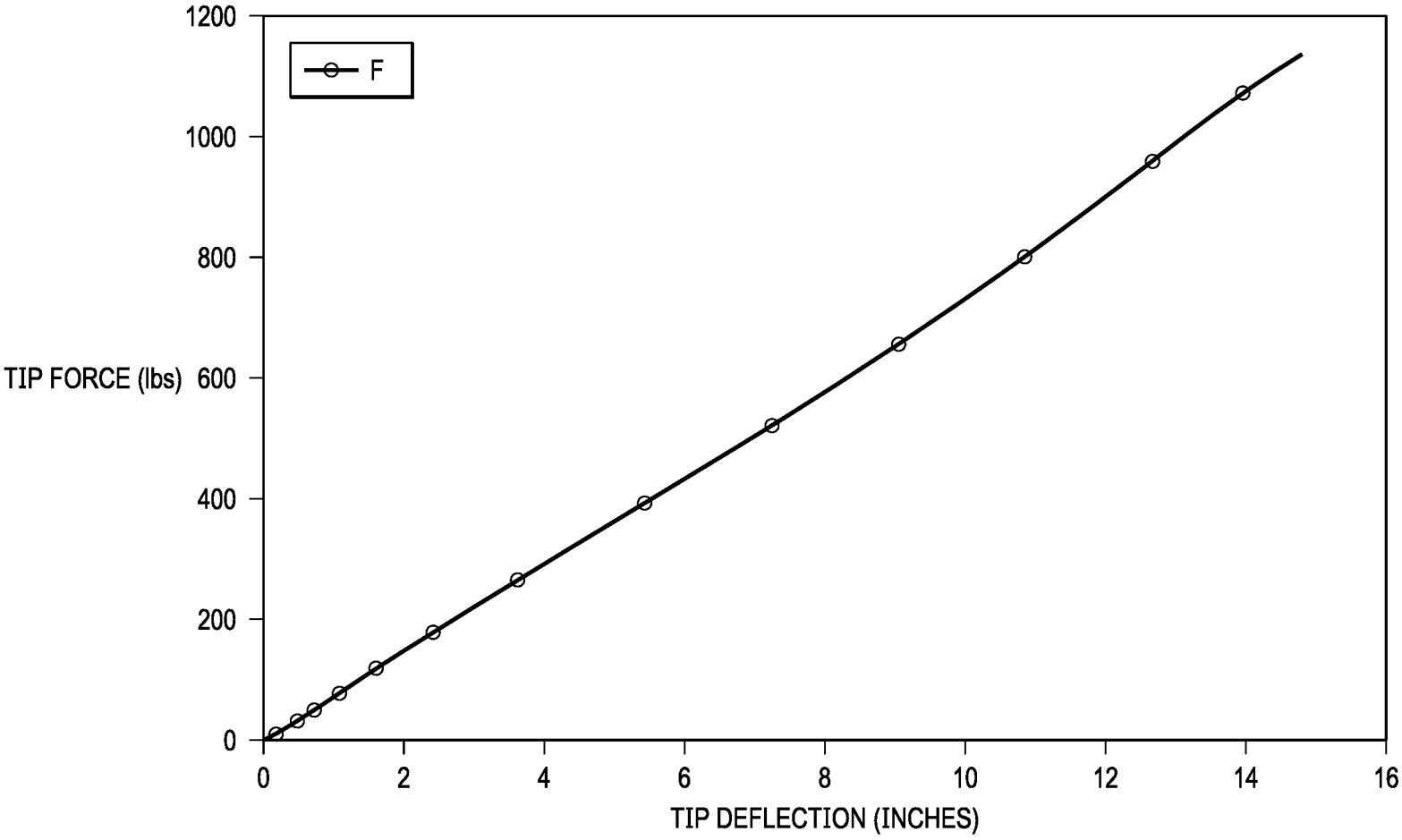
FIG. 27 is a plot depicting the relationship between a tip force provided to the bow limb of FIGS. 23-26 and the resulting tip deflection of the bow limb.

Referring now to FIG. 27, a plot is illustrated that depicts one example of the relationship between a tip force (e.g., load) provided to the distal ends 718, 818 of the respective bow limbs 716, 816 (in pounds of force) and the resulting tip deflection of the bow limbs 716, 816 (in inches) illustrated in FIGS. 23-26.

Figure 28:
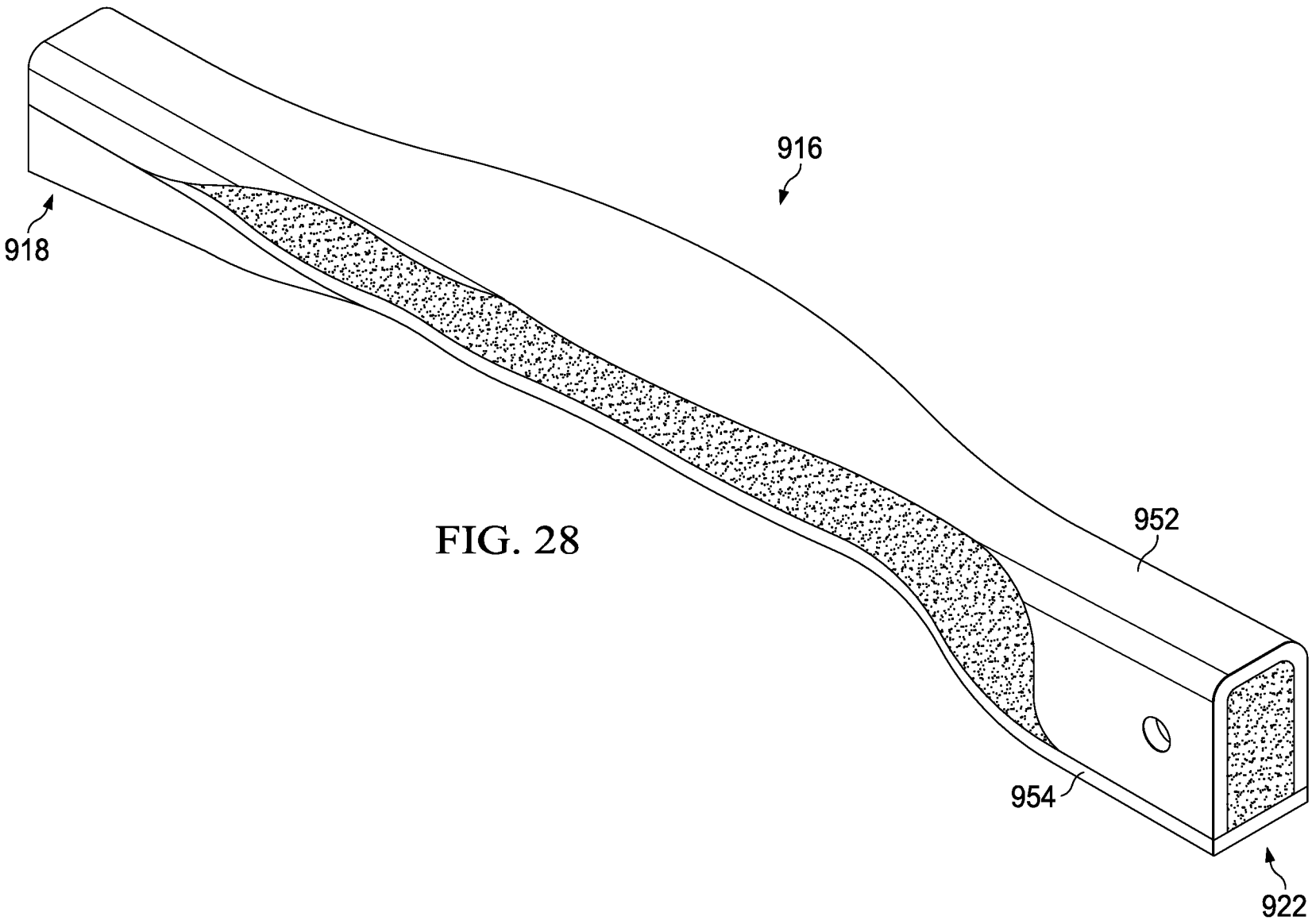
FIG. 28 is a side isometric view depicting a bow limb of a crossbow, in accordance with still yet another embodiment.

FIG. 28 illustrates yet another alternative embodiment of a bow limb 916 that is similar to or the same in many respects as the bow limb 516 illustrated in FIGS. 6-13. For example, the bow limb 916 can extend between a distal end 918 and a proximal end 922 and can include an outer elongate member 952, an inner elongate member 954, and a core member 956 that is sandwiched between the outer and inner elongate members 952, 954.

Figure 29:
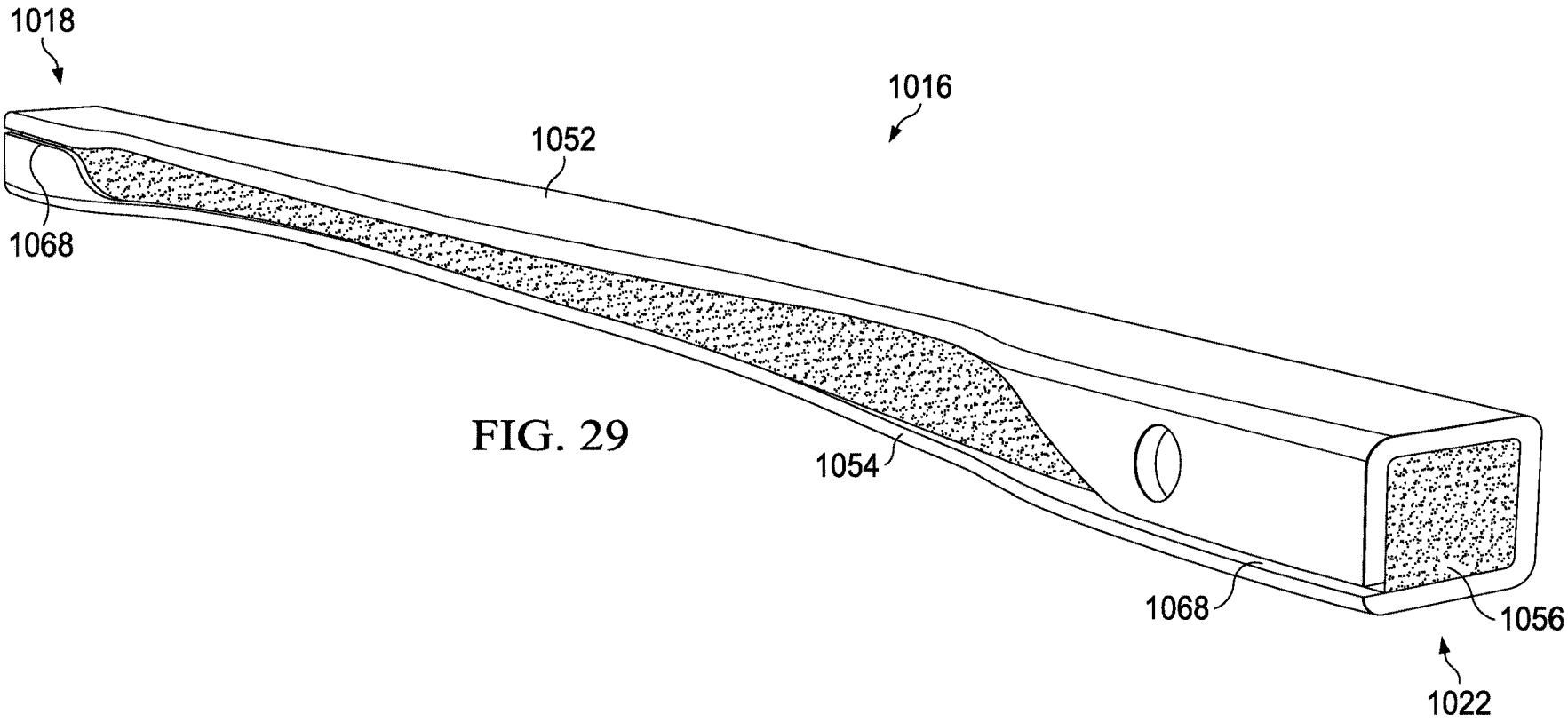
FIG. 29 is a side isometric view depicting a bow limb of a crossbow, in accordance with still yet another embodiment.

FIG. 29 illustrates still yet another alternative embodiment of a bow limb 1016 that is similar to or the same in many respects as the bow limb 516 illustrated in FIGS. 6-13. For example, the bow limb 1016 can extend between a proximal end 1018 and a distal end 1022 and can include an outer elongate member 1052, an inner elongate member 1054, and a core member 1056 that is sandwiched between the outer and inner elongate members 1052, 1054. However, the outer elongate member 1052 and the inner elongate member 1054 can be formed together as a one piece construction that defines a seam 1068.

Figure 30:
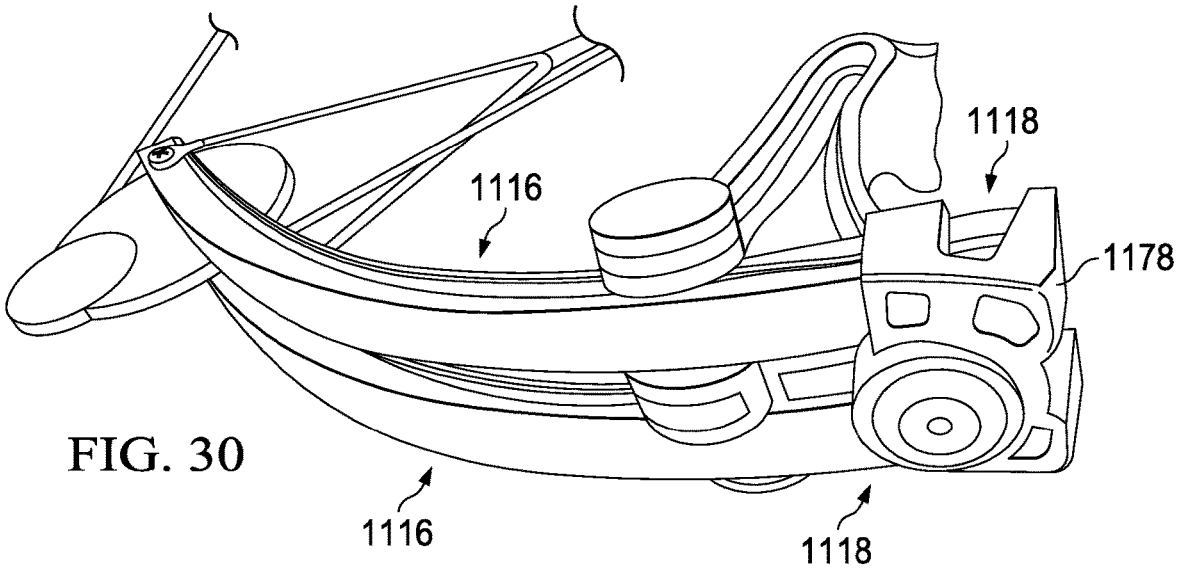
FIG. 30 is a front isometric view depicting a portion of a right side of a crossbow that incorporates two bow limbs, in accordance with still yet another embodiment.

FIG. 30 illustrates still yet another alternative embodiment of a pair of bow limbs 1116 that are each similar to or the same in many respects as the bow limb 516 illustrated in FIGS. 6-13. For example, each bow limb 1116 can include a proximal end 1118. However, the proximal end 1118 can have a flared profile (e.g., a width that increases as it approaches the proximal end 1118) that can alleviate the possibility of the bow limbs 1116 being pulled away from a riser 1178 when the bow limbs 1116 are bent into a firing position.

Figure 31:
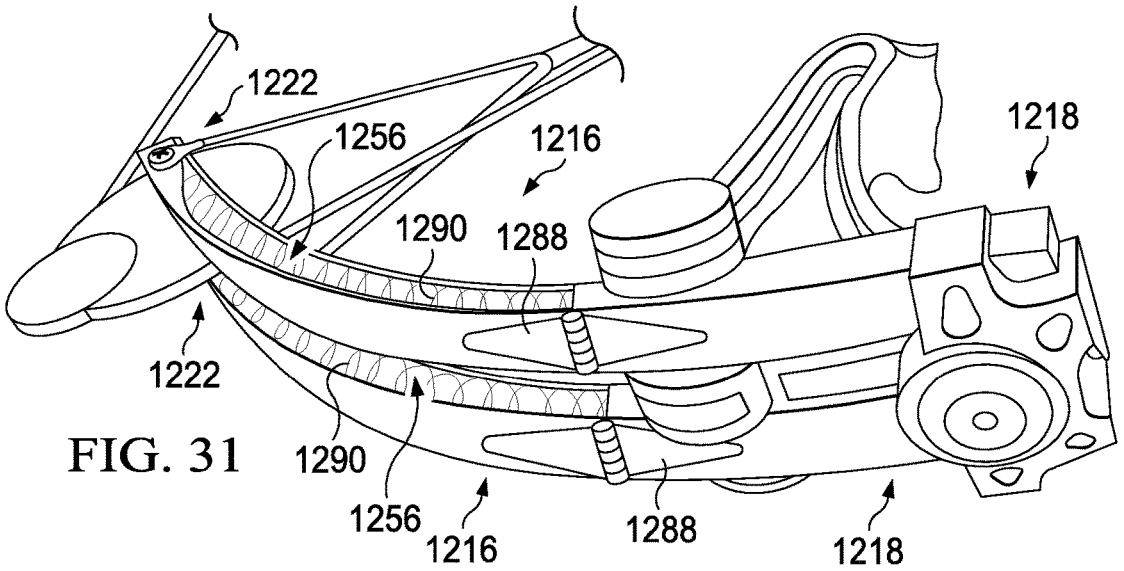
FIG. 31 is a front isometric view depicting a portion of a right side of a crossbow that incorporates two bow limbs, in accordance with still yet another embodiment.
Figure 32:
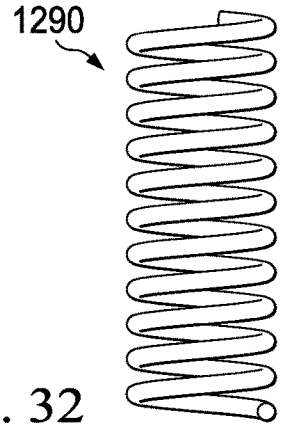
FIG. 32 is a front view of an embedded spring of the bow limbs of FIG. 31 with the embedded spring shown in a relaxed state.
Figure 33:
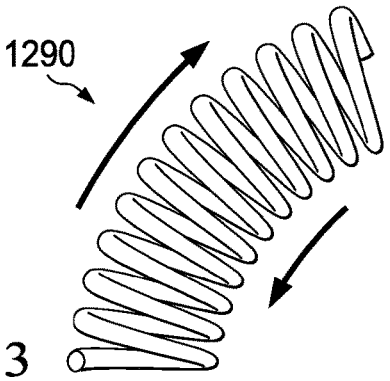
FIG. 33 is a front view of an embedded spring of the bow limbs of FIG. 31 with the embedded spring shown in a bent state.

FIG. 31 illustrates still yet another alternative embodiment of a pair of bow limbs 1216 that are each similar to or the same in many respects as the bow limb 516 illustrated in FIGS. 6-13. For example, each bow limb 1216 can include a proximal end 1218, a distal end 1222, and a core member 1256. However, each bow limb 1216 can include a hinge member 1288 that can facilitate pivoting of the distal end 1222 relative to the proximal end 1218. Each core member 1256 can also include an embedded spring 1290 that facilitates biasing of the associated bow limb 1216 into a straightened position. When the bow limbs 1216 are in a straightened position, each embedded spring 1290 can be in a relaxed state (see FIG. 32). When the bow limbs 1216 are bent (e.g., in a firing position), each embedded spring 1290 can be in a bent state (see FIG. 33) which can facilitate biasing of the associated bow limb 1216 into the straightened position.

Figure 34:
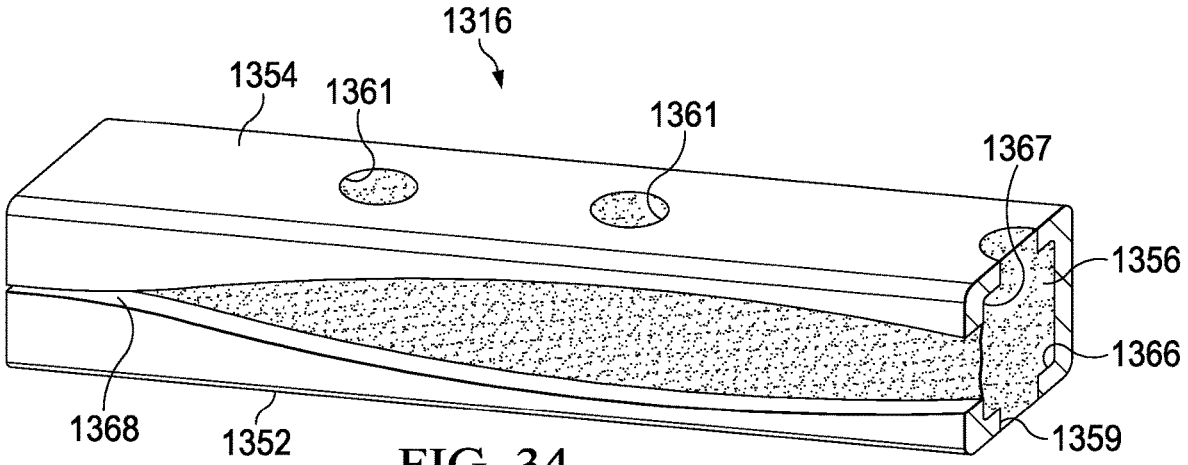
FIG. 34 is an enlarged front isometric view of a bow limb, in accordance with still yet another embodiment.
Figure 35:
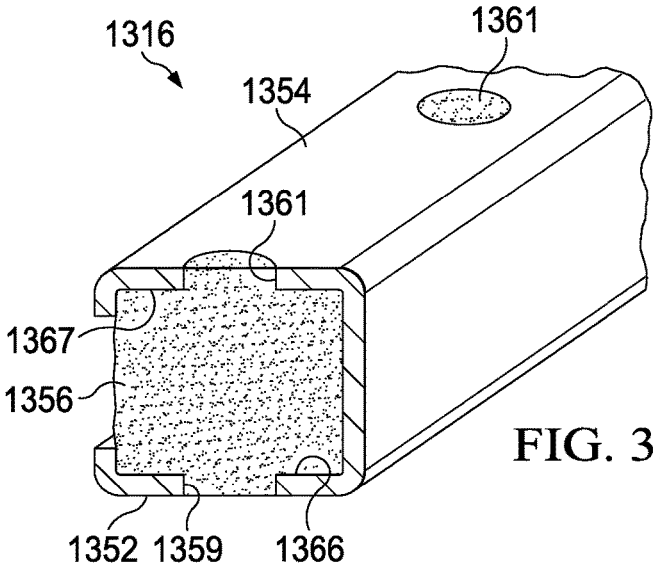
FIG. 35 is an end isometric view of the bow limb of FIG. 34.

FIGS. 34 and 35 illustrate still yet another alternative embodiment of a bow limb 1316 that is similar to or the same in many respects as the bow limb 516 illustrated in FIGS. 6-13. For example, the bow limb 1316 can include an outer elongate member 1352, an inner elongate member 1354, and a core member 1356 sandwiched between the outer elongate member 1352 and the inner elongate member 1354. The core member 1356 can be mechanically coupled (e.g., interlocked) with respective interior surfaces 1366, 1367 of the outer elongate member 1352 and the inner elongate member 1354 (e.g., via adhesive or any of a variety of other suitable attachment methods).

However, the outer elongate member 1352 and the inner elongate member 1354 can be formed together as a one piece construction that defines a seam 1368. The outer elongate member 1352 can define through holes 1359 (one shown) and the inner elongate member 1354 can define through holes 1361. The core member 1356 can extend at least partially into each of these through holes 1359, 1361 to enhance the mechanical coupling and the resistance of shear between the core member 1356 and the outer and inner elongate members 1352, 1354.

Figure 36:
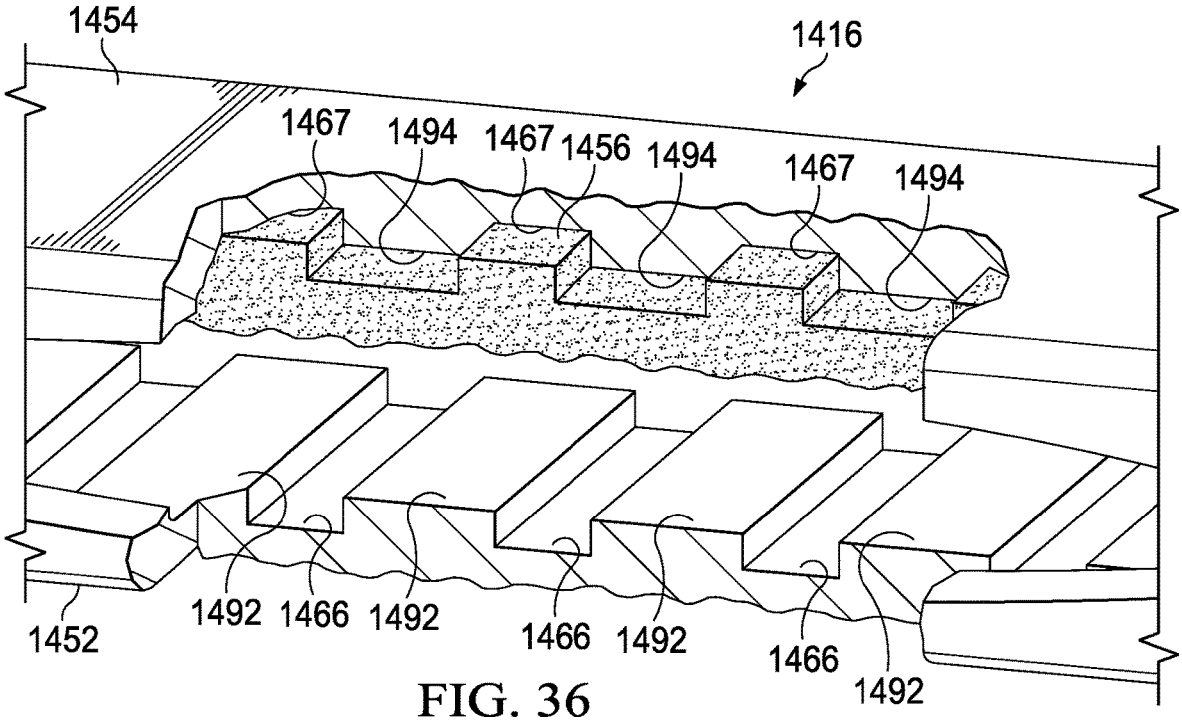
FIG. 36 is an enlarged front isometric view depicting a bow limb, in accordance with still yet another embodiment, wherein an outer elongate member, an inner elongate member, and a core member are partially cut away and a portion of the core member has been removed for clarity of illustration.
Figure 37:
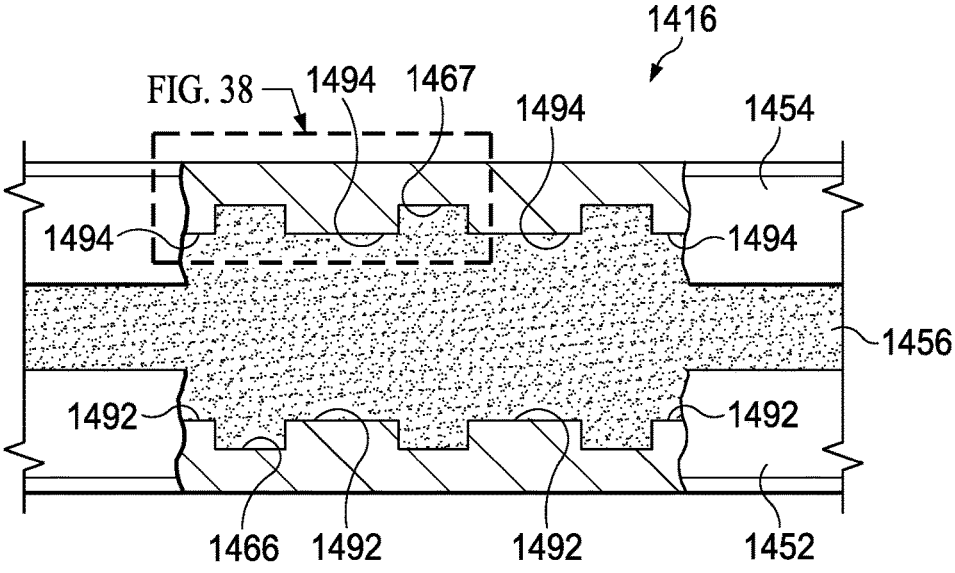
FIG. 37 is a side view of the bow limb of FIG. 36, but with the core member shown in its entirety.
Figure 38:
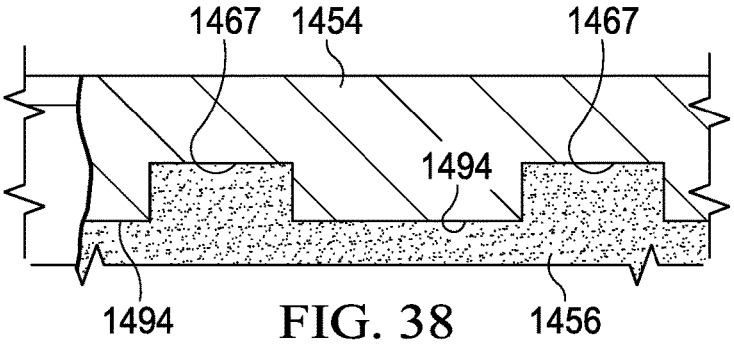
FIG. 38 is an enlarged view depicting the encircled portion of FIG. 37.

FIGS. 36-38 illustrate still yet another alternative embodiment of a bow limb 1416 that is similar to or the same in many respects as the bow limb 516 illustrated in FIGS. 6-13. For example, the bow limb 1416 can include an outer elongate member 1452, an inner elongate member 1454, and a core member 1456 sandwiched between the outer elongate member 1452 and the inner elongate member 1454. The core member 1456 can be mechanically coupled with respective interior surfaces 1466, 1467 of the outer elongate member 1452 and the inner elongate member 1454 (e.g., via adhesive or any of a variety of other suitable attachment methods).

However, the outer elongate member 1452 and the inner elongate member 1454 can be formed together as a one piece construction that defines a seam (not shown). The outer elongate member 1452 can include a plurality of internal rib members 1492 and the inner elongate member 1454 can include a plurality of internal rib members 1494. The internal rib members 1492, 1494 extend into the core member 1456 to enhance the mechanical coupling and the resistance of shear therebetween. As illustrated in FIGS. 37 and 38, each of the internal rib members 1492, 1494 can have a generally rectangular cross-sectional shape. In one embodiment, as illustrated in FIG. 37, each of the internal rib members 1492 can be substantially vertically aligned with respective ones of the internal rib members 1494.

Figure 39:
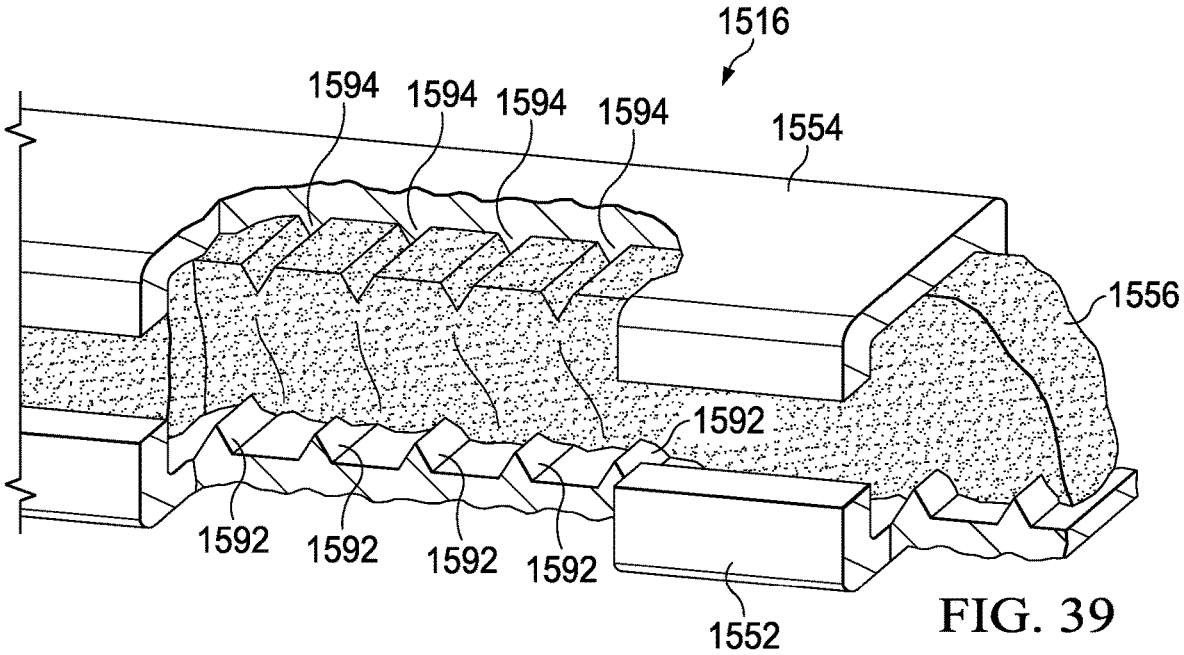
FIG. 39 is an enlarged front isometric view depicting a bow limb, in accordance with still yet another embodiment, wherein an outer elongate member, an inner elongate member, and a core member are shown partially cut away for clarity of illustration.
Figure 40:
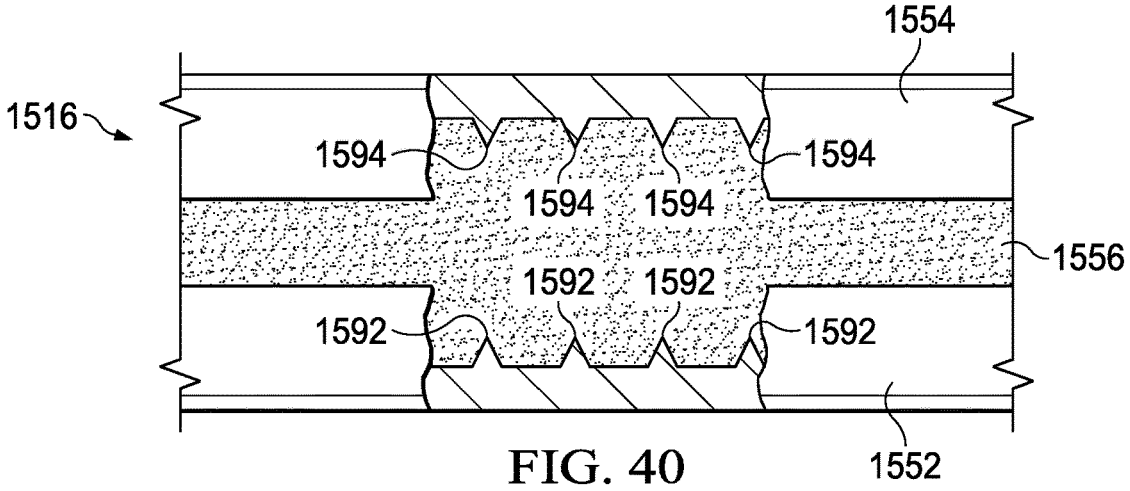
FIG. 40 is an enlarged side view of the bow limb of FIG. 39.

FIGS. 39 and 40 illustrate still yet another alternative embodiment of a bow limb 1516 that is similar to or the same in many respects as the bow limb 1416 illustrated in FIGS. 36-38. For example, the bow limb 1516 can include an outer elongate member 1552, an inner elongate member 1554, and a core member 1556 sandwiched between the outer elongate member 1552 and the inner elongate member 1554. The outer elongate member 1552 can include a plurality of internal rib members 1592 and the inner elongate member 1554 can include a plurality of internal rib members 1594. Each of the internal rib members 1592 can be substantially vertically aligned with respective ones of the internal rib members 1594. However, the internal rib members 1592, 1594 can each have a generally triangular cross-sectional shape.

Figure 41:
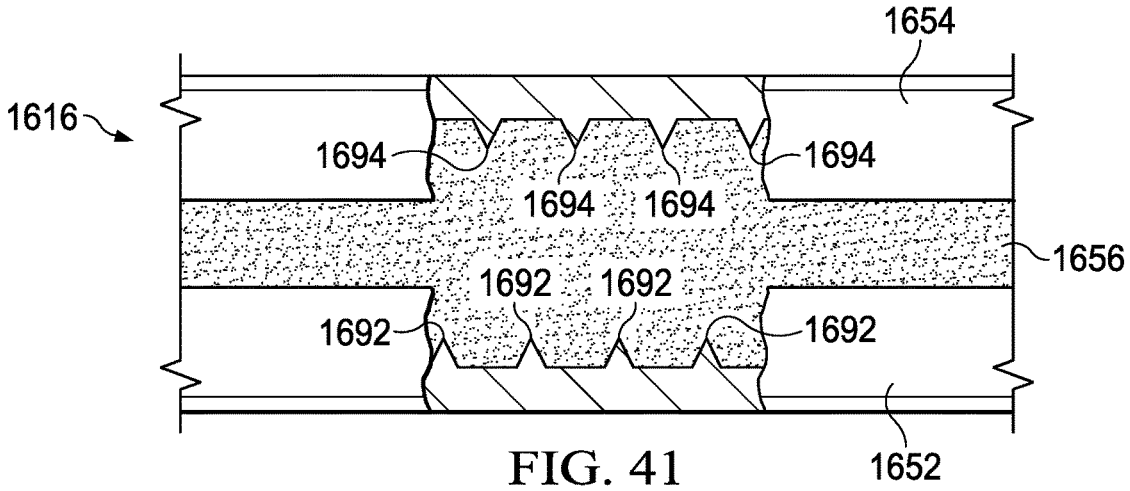
FIG. 41 is an enlarged side view depicting a bow limb, in accordance with still yet another embodiment.

FIG. 41 illustrates still yet another alternative embodiment of a bow limb 1616 that is similar to or the same in many respects as the bow limb 1516 illustrated in FIGS. 39 and 40. For example, the bow limb 1616 can include an outer elongate member 1652, an inner elongate member 1654, and a core member 1656 sandwiched between the outer elongate member 1652 and the inner elongate member 1654. The outer elongate member 1652 can include a plurality of internal rib members 1692 and the inner elongate member 1654 can include a plurality of internal rib members 1694. However, each of the internal rib members 1692 can be vertically offset from respective ones of the internal rib members 1694.

Figure 42:
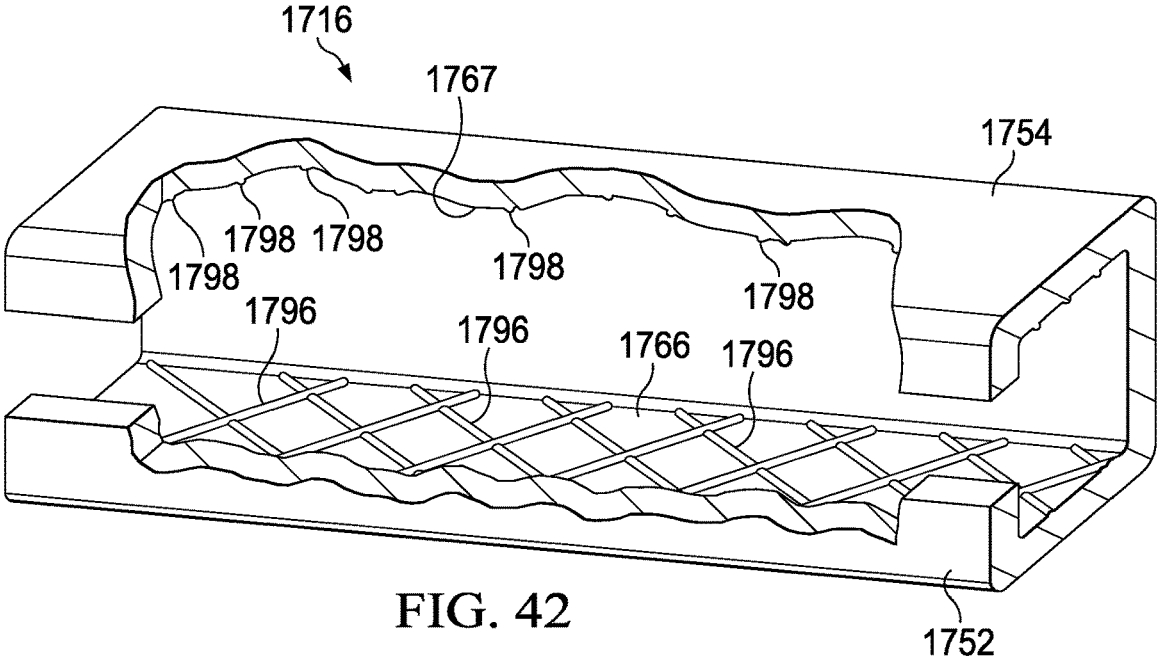
FIG. 42 is an enlarged front isometric view depicting a bow limb, in accordance with still yet another embodiment, wherein an outer elongate member and an inner elongate member are shown partially cut away for clarity of illustration.

FIG. 42 illustrates still yet another alternative embodiment of a bow limb 1716 that is similar to or the same in many respects as the bow limb 516 illustrated in FIGS. 6-13. For example, the bow limb 1716 can include an outer elongate member 1752 and an inner elongate member 1754 that include interior surfaces 1766, 1767, respectively. However, each of the interior surfaces 1766, 1767 can include textured portions 1796, 1798 that interface with a core member (not shown) in such a manner to enhance the mechanical coupling and the resistance of shear therebetween. In one embodiment, as illustrated in FIG. 42, the textured portions can be abrasive and formed into a lattice-type arrangement (see e.g., 1796). It is to be appreciated that any of a variety of suitable alternative mechanical features are contemplated for enhancing the mechanical coupling (e.g., interlocking) between a core member and an elongate member.

It is to be appreciated that the bow limbs described herein can be incorporated into any of a variety of suitable archery bows, such as, for example, a vertical bow or a compound bow. When incorporated into a vertical bow or a compound bow, each of the bow limbs can be coupled with respective risers that are disposed at opposing ends of a central hand grip that can be grasped by a user to during draw back and release of an arrow.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A limb for an archery bow, the limb comprising:

an outer elongate member formed of a first material and comprising an interior surface and an exterior surface;

an inner elongate member formed of a second material and comprising an interior surface and an exterior surface; and a core member formed of a third material and sandwiched between the outer elongate member and the inner elongate member, the core member being coupled with at least a portion of each of the interior surfaces of the outer elongate member and the inner elongate member; wherein:

the outer elongate member defines a first plurality of through holes;

the inner elongate member defines a second plurality of through holes;

the core member extends at least partially into each of the first plurality of through holes and the second plurality of through holes;

the outer elongate member and the inner elongate member are configured to move relative to each other when the limb is bent; and the first material and the second material are each stiffer than the third material.

2. The limb of claim 1 wherein:

the first material and the second material comprise one or more of high strength steel, beryllium copper, and titanium; and the third material comprises an elastomeric material.

3. The limb of claim 2 wherein the third material further comprises fibers, and the elastomeric material is reinforced by the fibers.

4. The limb of claim 1 wherein:

the outer elongate member and the inner elongate member each comprise a central member and a pair of leg members that extend from and cooperate with the central member to define a c-shaped portion;

the core member is coupled with the interior surface located at the central member of each of the outer elongate member and the inner elongate member; and the core member is decoupled from the interior surfaces located at the leg members of each of the outer elongate member and the inner elongate member.

5. An archery bow comprising the limb of claim 1.

6. A limb for an archery bow, the limb comprising:

an outer elongate member formed of a first material and comprising an interior surface and an exterior surface;

an inner elongate member formed of a second material and comprising an interior surface and an exterior surface; and a core member formed of a third material and sandwiched between the outer elongate member and the inner elongate member, the core member being coupled with at least a portion of each of the interior surfaces of the outer elongate member and the inner elongate member; wherein:

the outer elongate member includes a first plurality of internal rib members that extend into the core member;

the inner elongate member includes a second plurality of internal rib members that extend into the core member;

the outer elongate member and the inner elongate member are configured to move relative to each other when the limb is bent; and the first material and the second material are each stiffer than the third material.

7. The limb of claim 6 wherein:

the first material and the second material comprise one or more of high strength steel, beryllium copper, and titanium; and the third material comprises an elastomeric material.

8. The limb of claim 7 wherein the third material further comprises fibers, and the elastomeric material is reinforced by the fibers.

9. The limb of claim 6 wherein:

the outer elongate member and the inner elongate member each comprise a central member and a pair of leg members that extend from and cooperate with the central member to define a c-shaped portion;

the core member is coupled with the interior surface located at the central member of each of the outer elongate member and the inner elongate member; and the core member is decoupled from the interior surfaces located at the leg members of each of the outer elongate member and the inner elongate member.

10. An archery bow comprising the limb of claim 6.

11. The limb of claim 6 wherein each one of the first plurality of internal rib members and each one of the second plurality of internal rib members has a generally rectangular cross-sectional shape.

12. The limb of claim 11 wherein each one of the first plurality of internal rib members is substantially aligned with a respective one of the second plurality of internal rib members.

13. The limb of claim 6 wherein each one of the first plurality of internal rib members and each one of the second plurality of internal rib members has a generally triangular cross-sectional shape.

14. A limb for an archery bow, the limb comprising:

an outer elongate member formed of a first material and comprising an interior surface and an exterior surface;

an inner elongate member formed of a second material and comprising an interior surface and an exterior surface; and a core member formed of a third material and sandwiched between the outer elongate member and the inner elongate member, the core member being coupled with at least a portion of each of the interior surfaces of the outer elongate member and the inner elongate member; wherein:

the interior surface of the outer elongate member comprises first textured portions;

the interior surface of the inner elongate member comprises second textured portions;

each of the first and second textured portions interface with the core member to facilitate mechanical coupling and resistance of shear between the core member and the outer and inner elongate members;

the outer elongate member and the inner elongate member are configured to move relative to each other when the limb is bent; and the first material and the second material are each stiffer than the third material.

15. The limb of claim 14 wherein:

the first material and the second material comprise one or more of high strength steel, beryllium copper, and titanium; and the third material comprises a fiber-reinforced elastomeric material.

16. The limb of claim 14 wherein:

the outer elongate member and the inner elongate member each comprise a central member and a pair of leg members that extend from and cooperate with the central member to define a c-shaped portion;

the core member is coupled with the interior surface located at the central member of each of the outer elongate member and the inner elongate member; and the core member is decoupled from the interior surfaces located at the leg members of each of the outer elongate member and the inner elongate member.

17. The limb of claim 14 wherein each of the first and second textured portions are abrasive and formed into a lattice-type arrangement.

18. The limb of claim 14 wherein the first material is the same as the second material.

19. The limb of claim 18 wherein the outer elongate member and the inner elongate member are formed together as a one piece construction that defines a seam.

20. An archery bow comprising the limb of claim 14.

* * * * *